US010189659B2

(12) United States Patent
Kuroda et al.

(10) Patent No.: US 10,189,659 B2
(45) Date of Patent: Jan. 29, 2019

(54) PAPER SHEET HANDLING APPARATUS AND PAPER SHEET HANDLING METHOD

(71) Applicant: GLORY LTD., Himeji-shi, Hyogo (JP)

(72) Inventors: Toshiyuki Kuroda, Hyogo (JP); Shuji Onishi, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 15/557,560

(22) PCT Filed: Feb. 26, 2016

(86) PCT No.: PCT/JP2016/055797

§ 371 (c)(1),
(2) Date: Sep. 12, 2017

(87) PCT Pub. No.: WO2016/143555

PCT Pub. Date: Sep. 15, 2016

(65) Prior Publication Data

US 2018/0057290 A1 Mar. 1, 2018

(30) Foreign Application Priority Data

Mar. 12, 2015 (JP) ..... 2015-049502

(51) Int. Cl.
*B65H 5/00* (2006.01)
*B65H 1/00* (2006.01)
(Continued)

(52) U.S. Cl.
CPC ..... *B65H 5/006* (2013.01); *B65H 1/00* (2013.01); *B65H 1/14* (2013.01); *B65H 5/008* (2013.01);
(Continued)

(58) Field of Classification Search
CPC ..... B65H 2301/422; B65H 2301/4224; B65H 2301/42242; B65H 2701/1912; B65H 5/006
See application file for complete search history.

(56) References Cited

U.S. PATENT DOCUMENTS 5,090,573 A 2/1992 Takahashi et al.
7,845,627 B2 * 12/2010 Hommochi ..... B42C 9/0037 270/58.07
(Continued)

FOREIGN PATENT DOCUMENTS

EP 3 185 222 A1 6/2017
JP 63-235234 A 9/1988
(Continued)

OTHER PUBLICATIONS

Written Opinion of the International Searching Authority (International Application No. PCT/JP2016/055797) (5 pages—dated Mar. 22, 2016).
(Continued)

*Primary Examiner* — Jeremy R Severson
(74) *Attorney, Agent, or Firm* — Renner, Kenner, Greive, Bobak, Taylor & Weber

(57) ABSTRACT

A paper sheet handling apparatus (for example, a banknote handling apparatus (10)) includes a first transporting unit (30) configured to transport a plurality of paper sheets in a stacked state in a horizontal state, a feeding unit (40) configured to feed the paper sheets one by one, and a second transporting unit (50) configured to transport to the feeding unit (40) the stacked paper sheets transported by the first transporting unit (30). The second transporting unit (50) causes the stacked paper sheets being in the horizontal state to be inclined at angle to a horizontal plane.

19 Claims, 10 Drawing Sheets

(51) Int. Cl.

| | |
|---|---|
| ***B65H 1/14*** | (2006.01) |
| ***B65H 5/02*** | (2006.01) |
| ***G07D 9/00*** | (2006.01) |
| ***B65H 7/02*** | (2006.01) |
| ***B65H 7/06*** | (2006.01) |
| ***G07D 11/00*** | (2006.01) |

(52) U.S. Cl.

CPC ..... *B65H 5/02* (2013.01); *B65H 7/02* (2013.01); *B65H 7/06* (2013.01); *G07D 9/00* (2013.01); *G07D 11/0021* (2013.01); *B65H 2301/42242* (2013.01); *B65H 2301/42262* (2013.01); *B65H 2511/214* (2013.01); *B65H 2701/1311* (2013.01); *B65H 2701/1912* (2013.01)

(56) References Cited

U.S. PATENT DOCUMENTS

| | | | | |
|---|---|---|---|---|
| 7,874,554 | B2 * | 1/2011 | Dopfer | B65H 1/263 271/157 |
| 8,448,517 | B2 * | 5/2013 | Itsumi | B65H 7/02 73/159 |
| 9,758,333 | B2 * | 9/2017 | Weng | B65H 29/10 |
| 2012/0280034 | A1 * | 11/2012 | Cha | G07D 11/0003 235/379 |
| 2014/0183817 | A1 * | 7/2014 | Hwang | B65H 31/3063 271/306 |
| 2017/0349392 | A1 * | 12/2017 | Gugel | B65H 5/006 |

FOREIGN PATENT DOCUMENTS

| | | | |
|---|---|---|---|
| JP | 10-21450 | A | 1/1998 |
| JP | 10-154255 | A | 6/1998 |
| JP | 2009-181372 | A | 8/2009 |
| JP | 2013-238945 | A | 11/2013 |
| WO | WO 2009/122508 | A1 | 10/2009 |
| WO | 2013/061457 | A1 | 5/2013 |
| WO | 2014/155645 | A1 | 10/2014 |

OTHER PUBLICATIONS

European Search Report (Application No. 16761526.9—PCT/JP2016/055797)(8 pages—dated Jun. 11, 2018).

* cited by examiner

PAPER SHEET HANDLING APPARATUS AND PAPER SHEET HANDLING METHOD

TECHNICAL FIELD

The present invention relates to a paper sheet handling apparatus that handles a paper sheet, such as a banknote, and a paper sheet handling method implemented by the paper sheet handling apparatus.

BACKGROUND ART

As a banknote depositing and dispensing machine used in a financial institution and the like, for example, the one that has been disclosed in International Patent Publication No. WO2009/122508A1 is known in the art. In this conventional banknote depositing and dispensing machine, stacked banknotes collectively inserted by a customer in a banknote inserting inlet are taken inside of a housing of the machine, and the banknotes are fed one by one by a banknote feeding unit to a transporting unit. The banknotes fed to the transporting unit are transported inside the housing by this transporting unit, and denomination, authenticity, fitness and the like of the banknotes are recognized by a recognition unit. After the completion of the recognition by the recognition unit, the banknotes are temporarily escrowed in a temporary escrow unit. Once the deposition of the banknotes is confirmed, the banknotes temporarily escrowed in the temporary escrow unit transported and stored in a storing unit.

SUMMARY OF INVENTION

In the conventional banknote depositing and dispensing machine disclosed in International Patent Publication No. WO2009/122508A1, however, if foreign matter, such as a coin or a clip, is mixed with a plurality of banknotes in a stacked state, or stacked banknotes collectively inserted in the banknote inserting inlet, this foreign matter is also sent to the banknote feeding unit without falling out of the stacked banknotes. If the foreign matter is also fed by the banknote feeding unit to the transporting unit along with the banknotes when feeding the banknotes one by one, various problems such as the foreign matter getting jammed in the transporting unit might occur.

The present invention has been made in view of the above discussion. One object of the present invention is to provide a paper sheet handling apparatus and a paper sheet handling method that can remove foreign matter that got mixed with stacked paper sheets by inclining the paper sheets with respect to a horizontal plane from a horizontal state thereof before the paper sheets are fed one by one by a feeding unit.

A paper sheet handling apparatus of the present invention includes: a first transporting unit configured to transport a plurality of paper sheets in a stacked state in a horizontal state; a feeding unit configured to feed the paper sheets one by one; and a second transporting unit configured to transport to the feeding unit the stacked paper sheets transported by the first transporting unit, the second transporting unit causes the stacked paper sheets being in the horizontal state to be inclined at an angle to a horizontal plane.

In the paper sheet handling apparatus of the present invention, the second transporting unit may include a pair of sandwiching members that sandwich and/or grip the stacked paper sheets transported by the first transporting unit, and the second transporting unit may cause the stacked paper sheets sandwiched between the sandwiching members to be inclined at an angle to the horizontal plane.

In this case, the second transporting unit may be configured such that, after the stacked paper sheets sandwiched between the sandwiching members are inclined at an angle to the horizontal plane, the paper sheets may be released from the sandwiching members.

In the paper sheet handling apparatus of the present invention, the second transporting unit may be configured such that, after the stacked paper sheets sandwiched between the sandwiching members are inclined at an angle to the horizontal plane and these paper sheets are released from the sandwiching members, the sandwiching members may perform a back and forth movement.

In this case, the second transporting unit may be configured such that, after the stacked paper sheets sandwiched between the sandwiching members are inclined at an angle to the horizontal plane and the paper sheets are released from the sandwiching members, the sandwiching members may rotate around a predetermined axis.

Alternatively, the second transporting unit may be configured such that, after the stacked paper sheets sandwiched between the sandwiching members are inclined at an angle to the horizontal plane and the paper sheets are released from the sandwiching members, the sandwiching members may perform a back and forth movement in a direction being orthogonal to a direction of inclination of the paper sheets.

Alternatively, the second transporting unit may be configured such that, after the stacked paper sheets sandwiched between the sandwiching members are inclined at an angle to the horizontal plane and the paper sheets are released from the sandwiching members, the sandwiching members may perform a back and forth movement along a direction of inclination of the paper sheets.

In the paper sheet handling apparatus of the present invention, the second transporting unit may be configured such that, after the stacked paper sheets sandwiched between the sandwiching members are caused to be inclined at an angle to the horizontal plane, the sandwiching members may move to an upward position along a direction of inclination of the paper sheets, and after the sandwiching members have moved to the upward position, the stacked paper sheets sandwiched by the sandwiching members may be released from the sandwiching members.

Also, the second transporting unit may include a sliding member that slides the stacked paper sheets sandwiched between the sandwiching members, and the second transporting unit may be configured such that, after the stacked paper sheets sandwiched between the sandwiching members are caused to be inclined at an angle to the horizontal plane, the stacked paper sheets may be slid upward along the direction of inclination of the paper sheets by the sliding member, and then the stacked paper sheets may be released from the sandwiching members.

In the paper sheet handling apparatus of the present invention, the second transporting unit may further include a holding member configured to hold edges on a lower side of the stacked paper sheets that are inclined by the sandwiching members at an angle to the horizontal plane and released from the sandwiching members.

In this case, the second transporting unit may be configured such that, after the stacked paper sheets having been caused to be inclined at an angle to the horizontal plane are released from the sandwiching members, the holding member may change a holding state of the stacked paper sheets.

Further, the second transporting unit may be configured such that, after the stacked paper sheets having been caused to be inclined at an angle to the horizontal plane are released from the sandwiching members, the holding member may cause the stacked paper sheets to perform a back and forth movement.

In the paper sheet handling apparatus of the present invention, the second transporting unit may further include a hammering member configured to hammer the paper sheets to change the holding state of the stacked paper sheets by the holding member after the stacked paper sheets having been caused to be inclined at an angle to the horizontal plane are released from the sandwiching members.

Also, the sandwiching members may be arranged at a downstream end of the first transporting unit, and when the stacked paper sheets transported by the first transporting unit are being moved by the sandwiching members, the stacked paper sheets may be pushed on the sandwiching member side by the first transporting unit.

In the paper sheet handling apparatus of the present invention, the second transporting unit may be configured such that, when releasing the stacked paper sheets having been caused to be inclined at an angle to the horizontal plane from the sandwiching members, an operation of moving the sandwiching members away from each other may be stopped when a distance between one of the sandwiching members among the sandwiching members and the paper sheet becomes a predetermined distance is stopped.

In this case, the second transporting unit may further include a detecting member configured to detect a distance between the sandwiching members, and when a distance between the sandwiching members detected by the detecting member becomes a predetermined distance based on the number of paper sheets present between the sandwiching members, the operation of moving the sandwiching members away from each other may be stopped.

Also, the stacked paper sheets to be ejected to the outside of a housing may be sent to the second transporting unit, and the stacked paper sheets to be ejected to the outside of the housing and sent to the second transporting unit may be caused to be inclined at an angle to the horizontal plane after the stacked paper sheets are sandwiched between the sandwiching members and released from the sandwiching members, the edges of the stacked paper sheets may be aligned by the edges on the lower side of the stacked paper sheets being held by the holding member.

In the paper sheet handling apparatus of the present invention, the first transporting unit or the second transporting unit may include a foreign matter detecting unit configured to detect foreign matter other than the paper sheet, and the second transporting unit is configured such that, only when the foreign matter is detected by the foreign matter detecting unit, the stacked paper sheets sandwiched between by the sandwiching members may be caused to be inclined at an angle to the horizontal plane, and after these paper sheets are released from the sandwiching members, the sandwiching members may perform the back and forth movement.

In the paper sheet handling apparatus of the present invention, one of the sandwiching members among the sandwiching members may push the stacked paper sheets on the feeding unit side when the paper sheets are being fed by the feeding unit.

A paper sheet handling method of the present invention includes: transporting a plurality of paper sheets in a stacked state in a horizontal state by a first transporting unit; transporting the stacked paper sheets transported by the first transporting unit by a second transporting unit; and feeding the stacked paper sheets transported by the second transporting unit by a feeding unit one by one, when transporting the stacked paper sheets by the second transporting unit from the first transporting unit to the feeding unit, the stacked paper sheets being in the horizontal state are caused to incline at an angle to a horizontal plane.

DESCRIPTION OF EMBODIMENT

Figure 1:
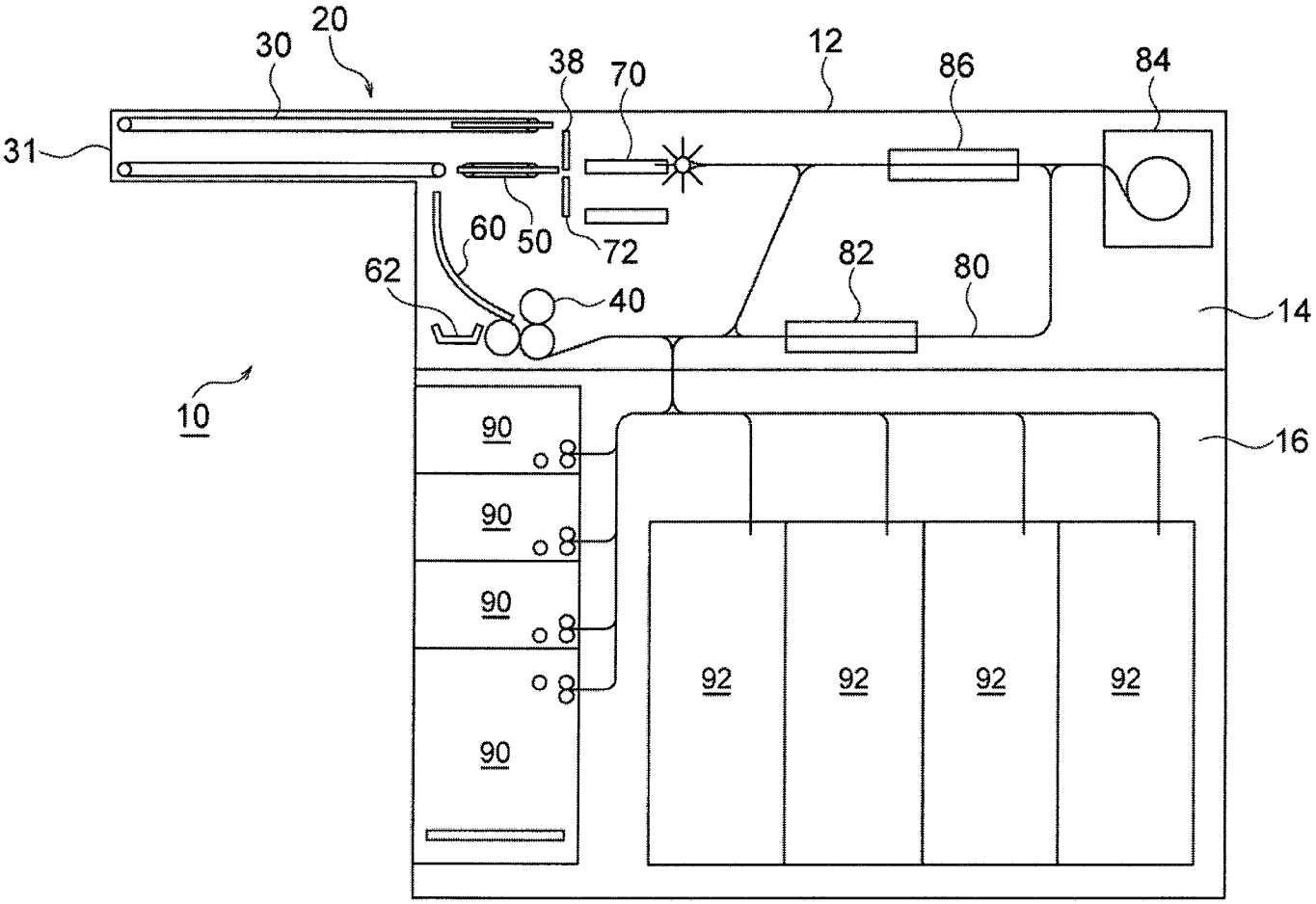
FIG. 1 is a schematic configurational diagram of a configuration of inside of a banknote handling apparatus according to an embodiment of the present invention.
Figure 7:
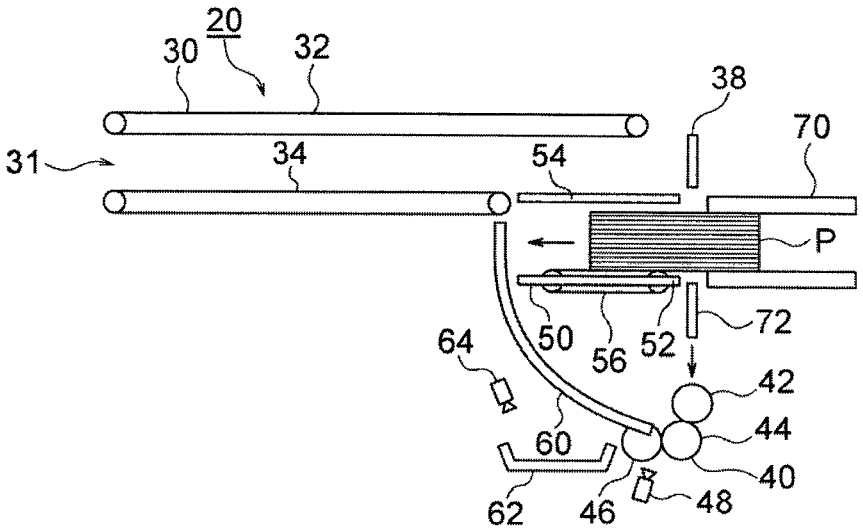
FIG. 7 is a side view of a state in which, in the banknote ejecting/inserting mechanism shown in FIG. 2 and the like, the stacked banknotes are being delivered from a dispensing temporary escrow unit to the second transporting unit.
Figure 8:
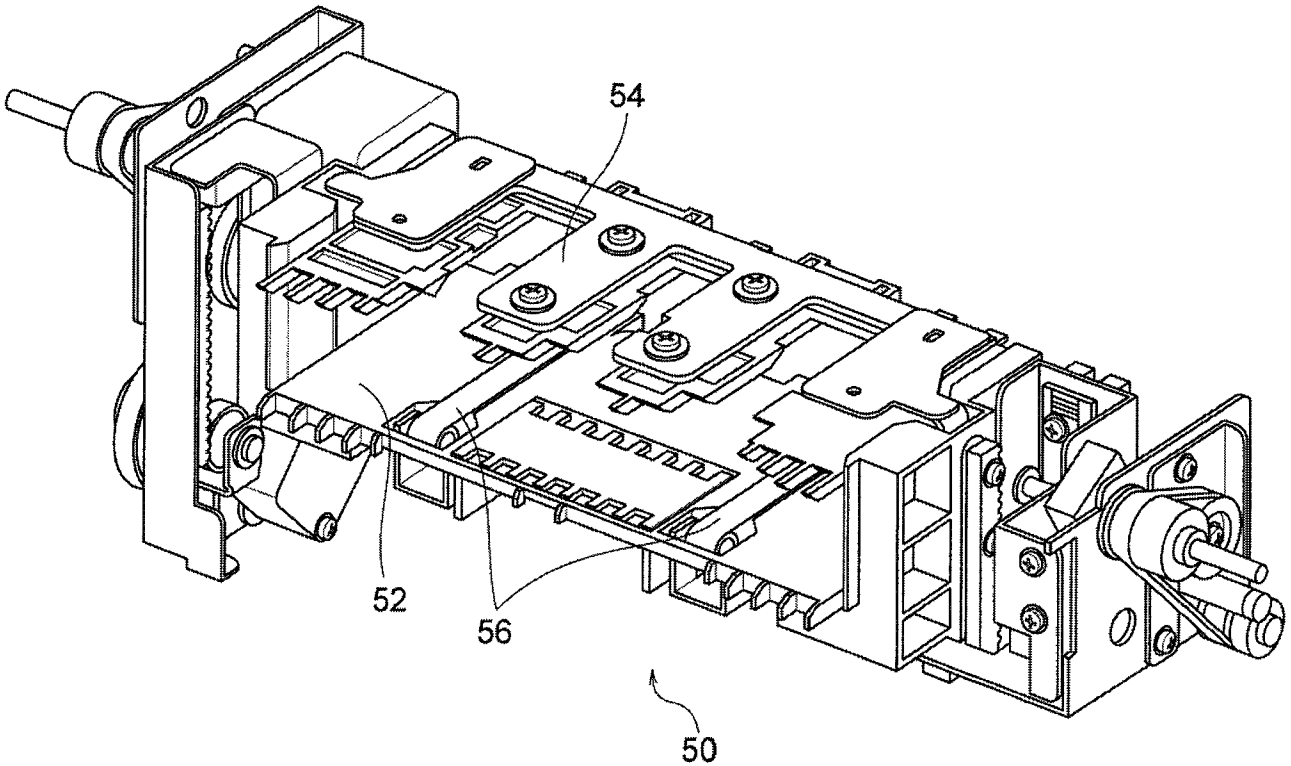
FIG. 8 is a perspective view of a configuration of the second transporting unit arranged in the banknote ejecting/inserting mechanism shown in FIG. 2 and the like and is the perspective view of a state before the stacked banknotes are sandwiched between a pair of sandwiching members.
Figure 9:
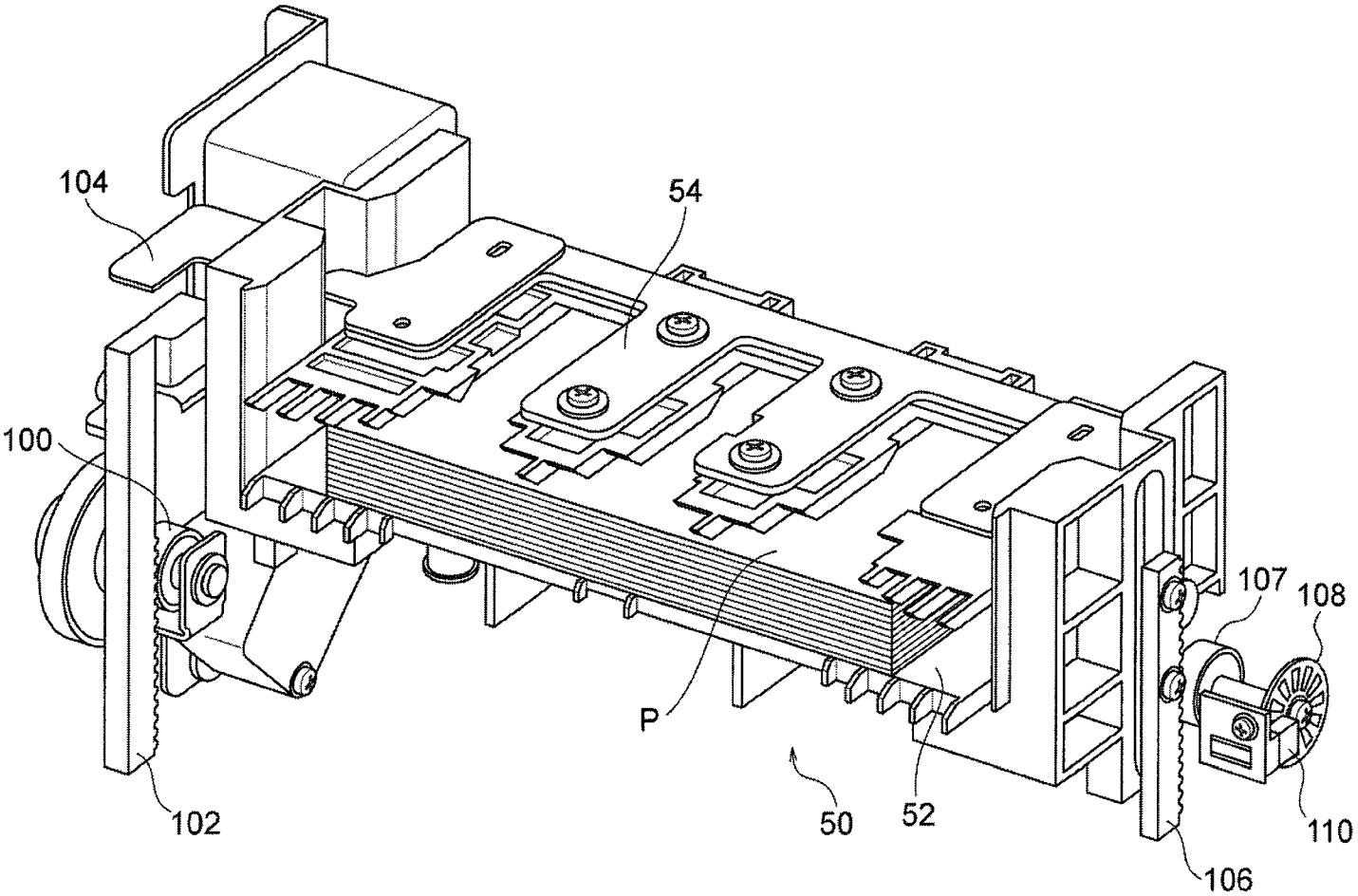
FIG. 9 is a perspective view of a state in which, in the second transporting unit shown in FIG. 8, the stacked banknotes have been sandwiched and/or gripped between the sandwiching members.
Figure 10:
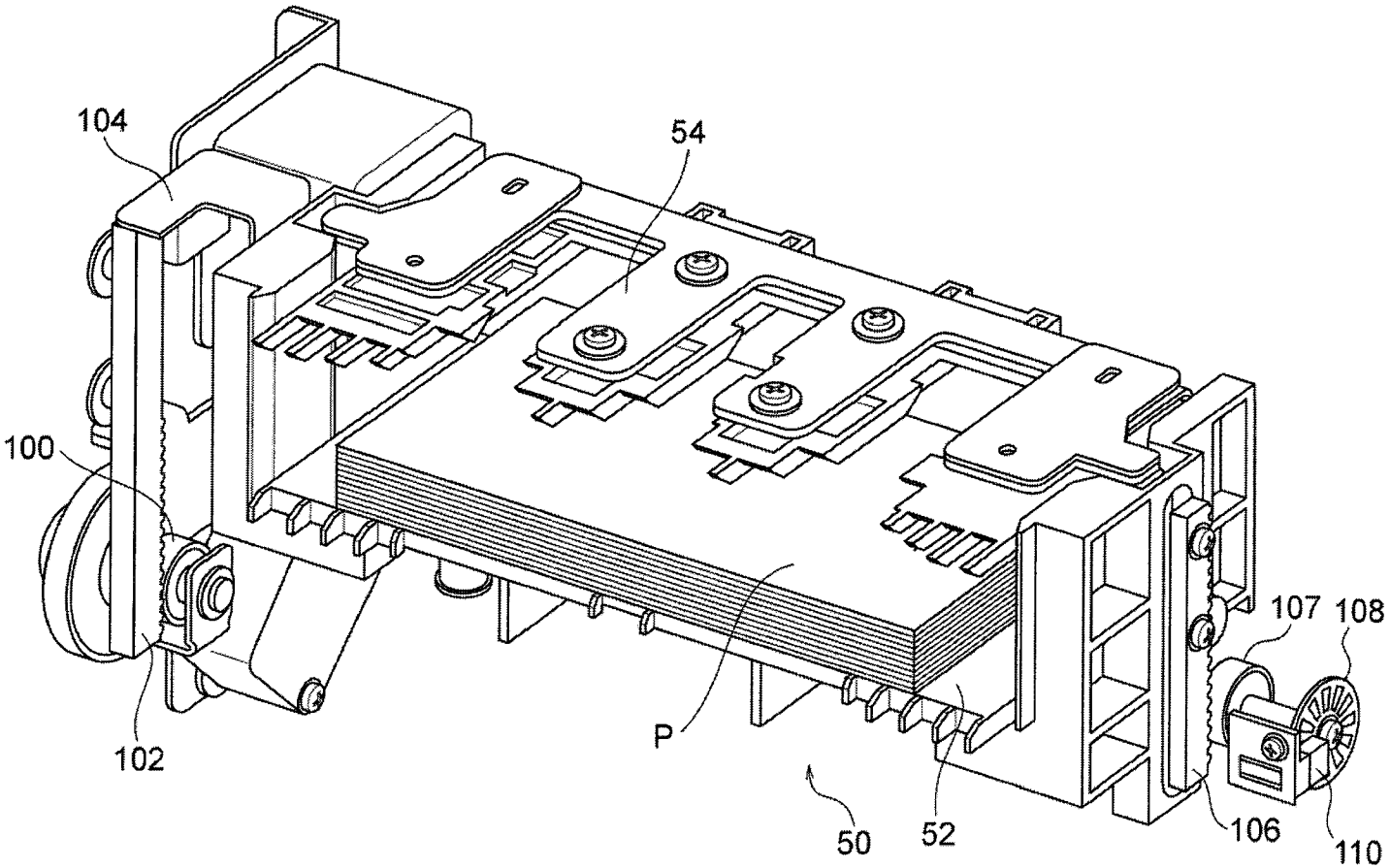
FIG. 10 is a perspective view of a state in which, in the second transporting unit shown in FIG. 8 and the like, the stacked banknotes have been released from the sandwiching members.
Figure 11:
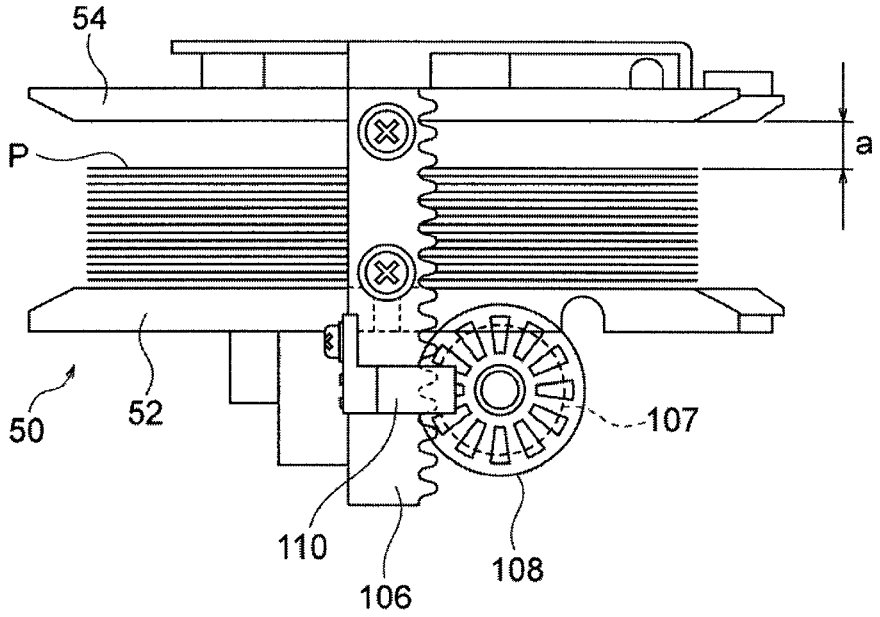
FIG. 11 is a side view of a state in which, in the second transporting unit shown in FIG. 8 and the like, the banknotes in a comparatively large number in the stacked state have been released from the sandwiching members.
Figure 12:
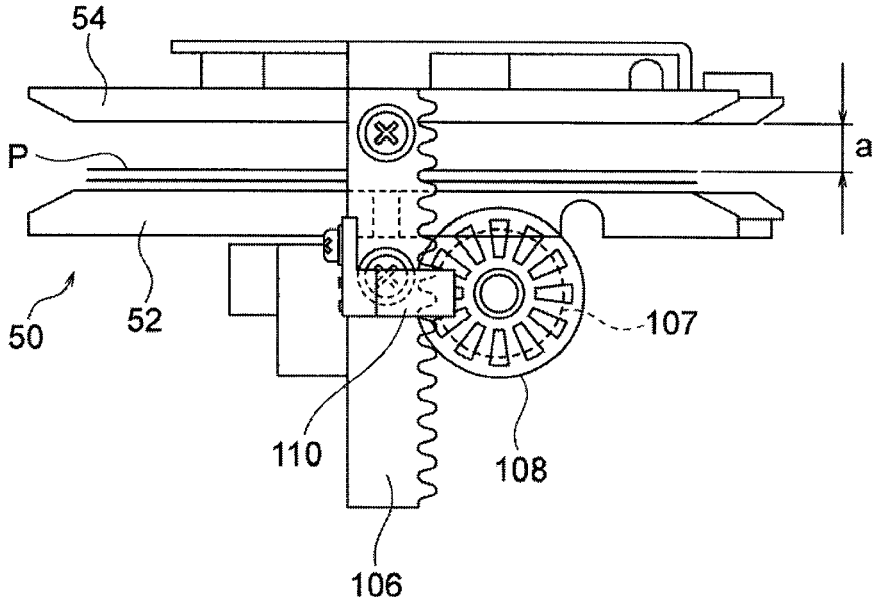
FIG. 12 is a side view of a state in which, in the second transporting unit shown in FIG. 8 and the like, the banknotes in a comparatively small number in the stacked state have been released from the sandwiching members.
Figure 13:
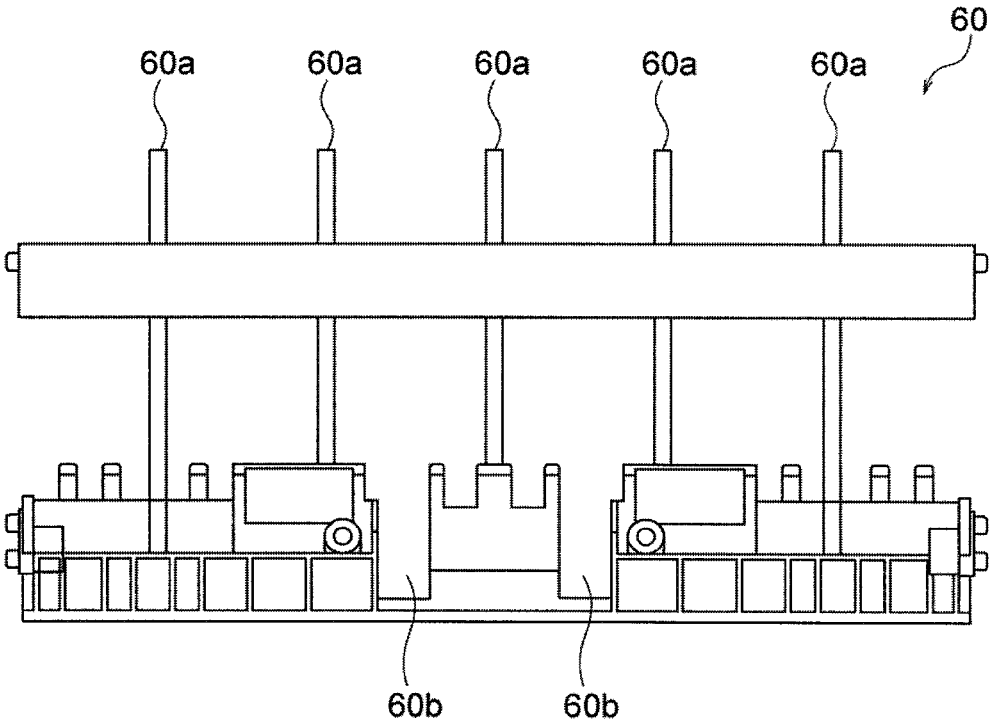
FIG. 13 is a front view of a configuration of a holding member arranged in the banknote ejecting/inserting mechanism in the banknote handling apparatus shown in FIG. 1.

Exemplary embodiments of the present invention are explained below with reference to the accompanying drawings. FIGS. 1 to 13 are views of a banknote handling apparatus and a banknote handling method implemented by the banknote handling apparatus according to the present embodiment. Of these, FIG. 1 is a schematic configurational diagram of a configuration of inside of the banknote handling apparatus according to the present embodiment. FIGS. 2 to 7 are side views of a configuration of a banknote ejecting/inserting mechanism in the banknote handling apparatus shown in FIG. 1. Moreover, FIGS. 8 to 10 are perspective views of a configuration of a second transporting unit arranged in the banknote ejecting/inserting mechanism shown in FIG. 2 and the like. FIGS. 11 and 12 are side views of a state in which, in the second transporting unit shown in FIG. 8 and the like, the stacked banknotes have been released from a pair of sandwiching members. FIG. 13 is a front view of a configuration of a holding member arranged in the banknote ejecting/inserting mechanism in the banknote handling apparatus shown in FIG. 1.

A banknote handling apparatus 10 according to the present embodiment has functions to perform various processes such as a money deposition process and a money dispensing process relating to banknotes. As shown in FIG. 1, the banknote handling apparatus 10 according to the present embodiment includes two units of an upper unit 14 and a lower unit 16. Moreover, the banknote handling apparatus 10 includes a housing 12 of a substantially rectangular parallelepiped shape and a banknote ejecting/inserting mechanism 20 for inserting the banknote from outside of the housing 12 to the inside thereof and ejecting the banknote from the inside of the housing 12 to the outside thereof. Note that, a side surface on the left hand side of the housing 12 in FIG. 1 is a front surface side of the housing 12, and the right direction in FIG. 1 is a depth direction of the housing 12. That is, the banknote ejecting/inserting mechanism 20 is arranged in the front surface side of the housing 12.

A transporting unit 80 that transports the banknotes one by one is arranged inside the housing 12 of the banknote handling apparatus 10. The banknote ejecting/inserting mechanism 20 includes a feeding unit 40 that feeds the banknotes one by one inserted in the banknote ejecting/inserting mechanism 20 from the outside of the housing 12. The banknotes fed by the feeding unit 40 are transported by the transporting unit 80. The transporting unit 80 includes a recognition unit 82. Denomination, fitness, authenticity and the like of the banknotes transported by the transporting unit 80 are recognized by the recognition unit 82. The recognition unit 82 includes an image sensor that captures an image of the banknote. In the recognition unit 82, information relating to a serial number of the banknote is acquired based on the image of the banknote captured by the image sensor.

A temporary escrow unit 84 is connected to the transporting unit 80. The banknotes fed by the feeding unit 40 to the transporting unit 80 and subjected to the recognition by the recognition unit 82 are sent to the temporary escrow unit 84 by the transporting unit 80, and temporarily escrowed in the temporary escrow unit 84. The transporting unit 80 is provided with a shifting unit 86. The shifting unit 86 shifts a position of the banknote transported by the transporting unit 80 in a direction that is orthogonal to a transport direction in which the banknote is transported by the transporting unit 80 (that is, a width direction of the banknote transported by the transporting unit 80). With the shifting unit 86, the banknote transported by the transporting unit 80 can be shifted to the central position, for example, in a width direction of a transport path of the transporting unit 80.

A dispensing temporary escrow unit 70 is connected to the transporting unit 80. During the money dispensing process of the banknote, the banknotes fed from each of later-explained banknote cabinets 92 to the transporting unit 80 are accumulated in a stacked state in the dispensing temporary escrow unit 70 after being recognized by the recognition unit 82. When all the banknotes to be be dispensed are accumulated in the dispensing temporary escrow unit 70, the stacked banknotes are sent from the dispensing temporary escrow unit 70 to the banknote ejecting/inserting mechanism 20, and the stacked banknotes are ejected to the outside of the housing 12 by the banknote ejecting/inserting mechanism 20. A detailed ejecting operation of the stacked banknotes by the banknote ejecting/inserting mechanism 20 is explained later.

In the present embodiment, the banknote ejecting/inserting mechanism 20, the recognition unit 82, the temporary escrow unit 84, the shifting unit 86, and the dispensing temporary escrow unit 70 are arranged in the upper unit 14.

As shown in FIG. 1, a plurality of storing and feeding units 90 are arranged in the lower unit 16 of the banknote handling apparatus 10. Each of the storing and feeding units 90 is connected to the transporting unit 80. Each of the storing and feeding units 90 stores therein, in a stacked state, the banknotes received from the transporting unit 80. With a banknote feeding mechanism arranged in each of the storing and feeding units 90, the banknotes that have been stored in the storing and feeding units 90 can be fed one by one to the transporting unit 80. Moreover, the banknote cabinets 92 are arranged side-by-side in the lower unit 16 of the banknote handling apparatus 10. Each of the banknote cabinets 92 is connected to the transporting unit 80. Each of the banknote cabinets 92 stores therein, in a stacked state, the banknotes received from the transporting unit 80. With a banknote feeding mechanism arranged in each of the banknote cabinets 92, the banknotes that have been stored in the banknote cabinets 92 are fed one by one to the transporting unit 80. The banknotes are stored in each of the banknote cabinets 92 according to the denominations of the banknotes. With this configuration, the banknotes temporarily escrowed in the temporary escrow unit 84 are fed from the temporary escrow unit 84 to the transporting unit 80 based on a recognition result of the banknote obtained in the recognition unit 82, and are sent by the transporting unit 80 to an appropriate one of the banknote cabinets 92 according to the denomination of the banknote after passing them through the shifting unit 86.

A detailed configuration of the banknote ejecting/inserting mechanism 20 in the banknote handling apparatus 10 is explained below by using FIGS. 2 to 13.

Figure 2:
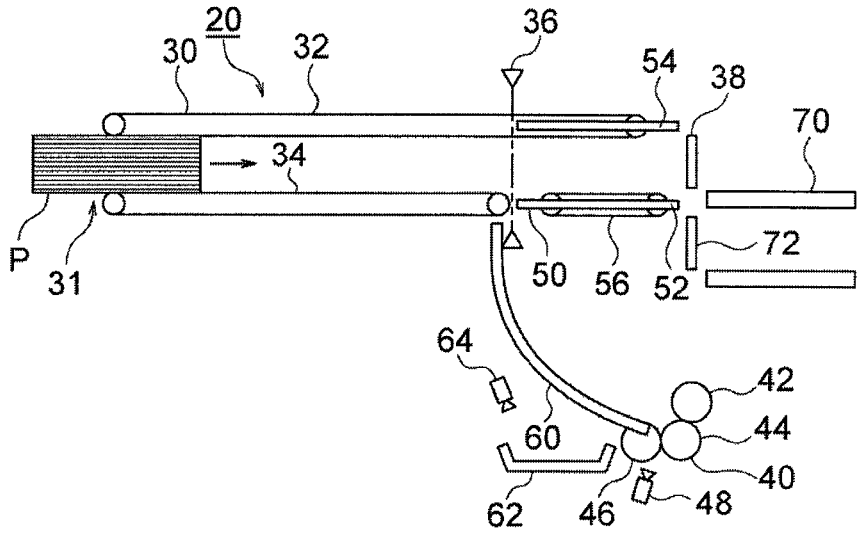
FIG. 2 is a side view of a configuration of a banknote ejecting/inserting mechanism in the banknote handling apparatus shown in FIG. 1 and is the side view in a state in which a plurality of banknotes in a stacked state have been inserted in a banknote ejecting/inserting inlet.
Figure 5:
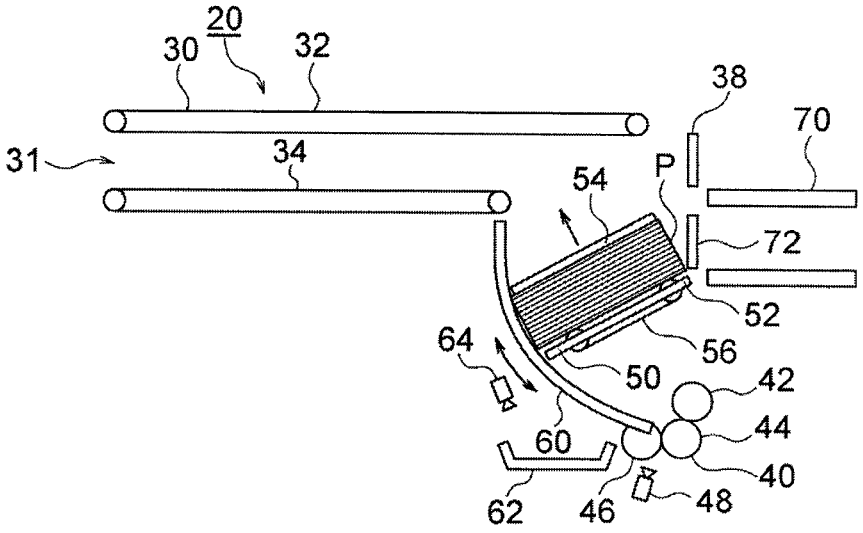
FIG. 5 is a side view of a state in which, in the banknote ejecting/inserting mechanism shown in FIG. 2 and the like, the stacked banknotes are being transported by the second transporting unit.

As shown in FIG. 2, the banknote ejecting/inserting mechanism 20 includes a first transporting unit 30 that transports the stacked banknotes in a horizontal state, the feeding unit 40 that feeds the banknotes one by one, and a second transporting unit 50 that transports the stacked banknotes that were transported by the first transporting unit 30 to the feeding unit 40. Moreover, as shown in FIG. 5, the second transporting unit 50 causes the stacked banknotes being in the horizontal state to be inclined at an angle to a horizontal plane. Details of various structural components of the banknote ejecting/inserting mechanism 20 are given below.

As shown in FIG. 2, the first transporting unit 30 includes a pair of endless belts 32 and 34 that are separated from each other in an up-down direction. These endless belts 32 and 34 extend in a horizontal direction. Between these endless belts 32 and 34 is formed a transporting region in which the stacked banknotes are transported in the horizontal state. Moreover, A banknote ejecting/inserting inlet 31 for inserting the stacked banknotes from the outside of the housing 12 to the inside thereof and ejecting the banknotes from the inside of the housing 12 to the outside thereof is provided between the ends of the endless belts 32 and 34 on the front surface side of the housing 12 (that is, between left ends of the endless belts 32 and 34 shown in FIG. 2). A banknote detecting sensor not shown in FIG. 2 is arranged in the banknote ejecting/inserting inlet 31. When the stacked banknotes are inserted in the banknote ejecting/inserting inlet 31, the banknotes are detected by the banknote detecting sensor. As shown in FIG. 2, a far end of the endless belt 32 on the upper side in the depth direction of the housing 12 is located further in the depth direction of the housing 12 (that is, a right side in FIG. 2 and the like) than a far end of the endless belt 34 on the lower side.

As shown in FIG. 2, near the far ends of the endless belts 32 and 34 (that is, the right side in FIG. 2) is arranged a receiving plate 38 that receives the stacked banknotes transported in the right direction in FIG. 2 by these endless belts 32 and 34. Because of the receiving plate 38, when the stacked banknotes are transported to the right direction in FIG. 2 by the endless belts 32 and 34, the stacked banknotes abut with the receiving plate 38. As a result, the stacked banknotes are no longer transported to the right direction in FIG. 2 and are appropriately delivered to the later-explained second transporting unit 50. In the first transporting unit 30, when inserting the banknotes from the outside of the housing 12 to the inside thereof, the stacked banknotes inserted in the banknote ejecting/inserting inlet 31 are sandwiched between the endless belts 32 and 34 and transported in the horizontal state in the right direction in FIG. 2 and the like. Moreover, when ejecting the banknotes from the inside of the housing 12 to the outside thereof, the stacked banknotes are sandwiched between the endless belts 32 and 34 and transported in the horizontal state in the left direction in FIG. 2 and the like, and are sent to the banknote ejecting/inserting inlet 31.

A banknote detecting sensor 36 that detects whether the stacked banknotes that have been delivered from the first transporting unit 30 to the later-explained second transporting unit 50 have protruded on the banknote ejecting/inserting inlet 31 side is arranged in the first transporting unit 30. If the stacked banknotes delivered from the first transporting unit 30 to the later-explained second transporting unit 50 have not protruded on the banknote ejecting/inserting inlet 31 side, the banknotes are not detected by the banknote detecting sensor 36. Whereas, if even some of the banknotes protrude on the banknote ejecting/inserting inlet 31 side among the stacked banknotes delivered to the second transporting unit 50, these protruding banknotes are detected by the banknote detecting sensor 36.

When inserting the banknotes from the outside of the housing 12 to the inside thereof, the stacked banknotes that are transported in the horizontal state in the right direction in FIG. 2 and the like while being sandwiched between the endless belts 32 and 34 in the first transporting unit 30 are delivered to the second transporting unit 50. As shown in FIGS. 2, 8, 9, and the like, the second transporting unit 50 includes a pair of plate-shaped sandwiching members 52 and 54 that are separated from each other in the up-down direction to grip the stacked banknotes. The stacked banknotes that were transported by the first transporting unit 30 are sandwiched and/or between the sandwiching members 52 and 54. Each of the sandwiching members 52 and 54 are movable between a first position at which the stacked banknotes are delivered by the first transporting unit 30 (that is, a position shown in FIG. 2 or 3) and a second position at which the stacked banknotes are delivered to the feeding unit 40 (that is, a position shown in FIG. 6). When the sandwiching members 52 and 54 move from the first position to the second position, the stacked banknotes sandwiched between these sandwiching members 52 and 54 are caused to be inclined from the horizontal state thereof shown in FIG. 2 or 3 so as to make an angle with respect to the horizontal plane. Moreover, the sandwiching member 54 on the upper side is movable toward the sandwiching member 52 on the lower side or away from the sandwiching member 52 on the lower side. When the stacked banknotes are present between the sandwiching member 54 on the upper side and the sandwiching member 52 on the lower side, the stacked banknotes can be sandwiched between these sandwiching members 52 and 54 by moving the sandwiching member 54 on the upper side toward the sandwiching member 52 on the lower side. Whereas, when the stacked banknotes have been sandwiched between these sandwiching members 52 and 54, the stacked banknotes are released from between these sandwiching members 52 and 54 by moving the sandwiching member 54 on the upper side away from the sandwiching member 52 on the lower side. A detailed operation of these sandwiching members 52 and 54 is explained later.

As shown in FIGS. 2, 8, in the second transporting unit 50, the sandwiching member 52 on the lower side is provided with a pair of left and right endless belts 56. Each of the endless belts 56 slightly protrudes upward above a top surface of the sandwiching member 52 on the lower side. When the stacked banknotes are sandwiched between the sandwiching members 52 and 54, the stacked banknotes contact each of the endless belts 56. Moreover, each of the endless belts 56 can move the stacked banknotes that are riding on the sandwiching member 52 on the lower side in the left-right direction in FIG. 2 and the like.

As shown in FIG. 2, the second transporting unit 50 includes a holding member 60 that extends along a trajectory of ends on the left hand side of the sandwiching members 52 and 54 when the sandwiching members 52 and 54 move between the first position and the second position. As shown in FIG. 2, the holding member 60 has a curved shape that extends from an end on the right side of the endless belt 34 on the lower side of the first transporting unit 30 toward later-explained gate rollers 46 of the feeding unit 40. In more details, as shown in FIG. 13, the holding member 60 includes a plurality of parallel rod-like members 60*a*. Each of the rod-like members 60*a* has a curved shape that extends from the end on the right side of the endless belt 34 on the lower side of the first transporting unit 30 toward the later-explained gate rollers 46 of the feeding unit 40. Moreover, a space (opening) through which foreign matter, such as a coin or a clip, that has fallen out of the stacked banknotes being transported by the second transporting unit 50 passes is formed between the adjacent rod-like members 60*a*. Note that, the gate rollers 46 which are explained later pass through a pair of left and right openings 60*b* formed in the holding member 60 as shown in FIG. 13. As shown in FIG. 2, foreign matter receiving member 62 configured to receive the foreign matter therein, such as a coin or a clip, that has fallen out of the stacked banknotes being transported by the second transporting unit 50 is arranged below the holding member 60. Moreover, an image capturing unit 64, such as a camera configured to capture an image of the foreign matter receiving member 62 is arranged near the foreign matter receiving member 62. When foreign matter is received by the foreign matter receiving member 62, it can be detected that the foreign matter has been received by the foreign matter receiving member 62 from the image of the foreign matter receiving member 62 captured by the image capturing unit 64.

In the present embodiment, the stacked banknotes are inclined by the sandwiching members 52 and 54 of the second transporting unit 50 as shown in FIG. 5 at an angle to the horizontal plane, and edges on the lower side of the stacked banknotes that have been released from the sandwiching members 52 and 54 by the movement of the sandwiching member 54 on the upper side away from the sandwiching member 52 on the lower side are received by the holding member 60. At this stage, if foreign matter, such as a coin or a clip, is stuck between the stacked banknotes, the foreign matter falls down from the stacked banknotes, and further falls down from the holding member 60 after passing through the space between the rod-like members 60*a* of the holding member 60, and it is finally received by the foreign matter receiving member 62.

Figure 6:
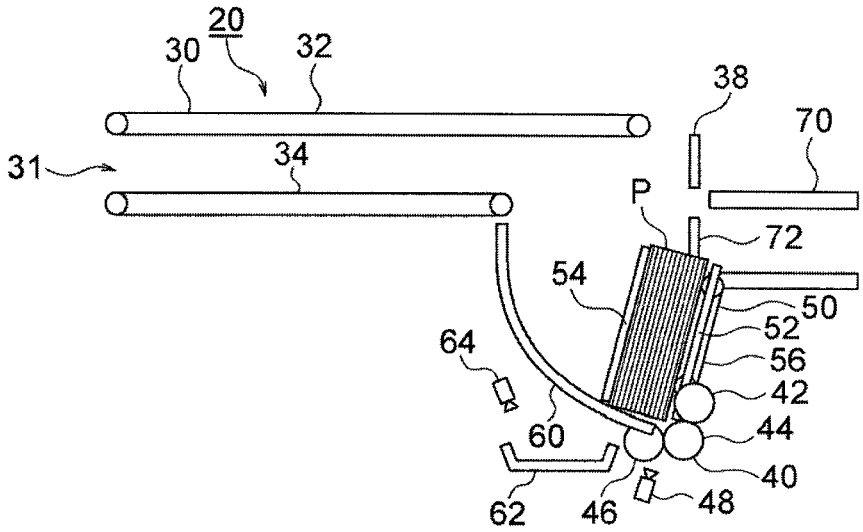
FIG. 6 is a side view of a state in which, in the banknote ejecting/inserting mechanism shown in FIG. 2 and the like, the stacked banknotes have been delivered by the second transporting unit to a feeding unit.

As shown in FIG. 2, the feeding unit 40 includes kicker rollers 42 that kick downward the stacked banknotes one by one delivered from the second transporting unit 50 to the feeding unit 40 at the second position shown in FIG. 6, feeding rollers 44 that feed the banknote that is kicked downward by the kicker rollers 42 to the inside of the housing 12, and the gate rollers 46 arranged opposed to the feeding rollers 44 to separate the banknotes one by one passing between itself and the feeding rollers 44. In the feeding unit 40, the banknotes that are kicked downward by the kicker rollers 42 pass through a gap between the feeding rollers 44 and the gate rollers 46. In doing so, the banknotes are separated one by one, and the banknote that passes through the gap between the feeding rollers 44 and the gate rollers 46 is sent to the transporting unit 80. Moreover, as shown in FIG. 2 and the like, an image capturing unit 48, such as a camera, is arranged below the feeding rollers 44 and the gate rollers 46 for capturing an image of the stacked banknotes delivered from the second transporting unit 50 to the feeding unit 40. If foreign matter, such as a coin or a clip, is sandwiched between the stacked banknotes delivered to the feeding unit 40, the foreign matter can be detected from the image captured by the image capturing unit 48. Note that, the operation of feeding the banknotes to the inside of the housing 12 by the feeding unit 40 is stopped when the foreign matter is detected by the image capturing unit 48. Moreover, in this case, a warning message is displayed on a not-shown displaying unit arranged on a front surface or a top surface of the housing 12 of the banknote handling apparatus 10 and/or a warning announcement is made from a not-shown speaker.

In the present embodiment, in the second transporting unit 50, when releasing the stacked banknotes from the sandwiching members 52 and 54 from the state thereof sandwiched between the sandwiching members 52 and 54, the sandwiching member 54 on the upper side is moved away from the sandwiching member 52 on the lower side, as mentioned earlier. During this operation, when a distance between the sandwiching member 54 on the upper side and the stacked banknotes reaches a predetermined distance, the operation of moving the sandwiching member 54 on the upper side away from the sandwiching member 52 on the lower side is stopped. A detailed configuration of the second transporting unit 50 is explained below by using FIGS. 9 to 12. FIG. 9 is a perspective view of a state in which, in the second transporting unit 50, the stacked banknotes have been sandwiched and gripped between the sandwiching members 52 and 54. FIG. 10 is a perspective view of a state in which, in the second transporting unit 50, the stacked banknotes have been released from the sandwiching members 52 and 54. FIG. 11 is a side view of a state in which, in the second transporting unit 50, the banknotes in a comparatively large number in the stacked state have been released from the sandwiching members 52 and 54. FIG. 12 is a side view of a state in which, in the second transporting unit 50, the banknotes in a comparatively small number in the stacked state have been released from the sandwiching members 52 and 54.

As shown in FIGS. 9 and 10, the sandwiching member 52 on the lower side is provided with a first pinion 100 driven by a not-shown driving motor and a first rack 102 engaged with teeth of the first pinion 100. The first rack 102 is movable in an up-down direction in FIG. 9 or 10 by driving of the first pinion 100. Moreover, the sandwiching member 54 on the upper side is provided with a pushed member 104 that can abut with an upper end of the first rack 102. When the first pinion 100 is driven whereby the first rack 102 moves in an upper direction in FIG. 9, the upper end of the first rack 102 contacts the pushed member 104. When the first pinion 100 is driven further whereby the first rack 102 further moves in the upper direction, the pushed member 104 is pushed by the first rack 102 in the upper direction. As a result, the sandwiching member 54 on the upper side moves away (that is, in the upper direction in FIG. 9 or 10) from the sandwiching member 52 on the lower side.

As shown in FIGS. 9 to 12, the sandwiching member 54 on the upper side is provided with a second rack 106 and a second pinion 107 having teeth formed on an outer peripheral surface thereof that can engage with teeth of the second rack 106. Moreover, a disk-shaped detecting plate 108 having a plurality of through holes is arranged in a coaxial state with the second pinion 107. The second pinion 107 and the detecting plate 108 rotate in a synchronized state. Moreover, a photointerrupter 110 is arranged near the detecting plate 108. When an optical path between a light emitting element and a photodetecting element in the photointerrupter 110 is interrupted by the detecting plate 108, and then when one of the through holes of the detecting plate 108 gets aligned with the optical axis as the detecting plate 108 rotates, the photointerrupter 110 is in a light transmissive state. Thus, as the detecting plate 108 rotates, the photointerrupter 110 alternately repeats a light interruptive state and the light transmissive state. An amount of rotation of the second pinion 107, namely an amount of movement of the second rack 106, can be detected by using the detecting plate 108 and the photointerrupter 110.

In the present embodiment, when releasing the stacked banknotes from the sandwiching members 52 and 54 from the state thereof sandwiched between the sandwiching members 52 and 54, the first pinion 100 is driven by the not-shown driving motor so that the first rack 102 moves in the upper direction in FIG. 9. After the upper end of the first rack 102 contacts the pushed member 104, when the first pinion 100 is driven further whereby the first rack 102 further moves in the upper direction, the pushed member 104 is pushed by the first rack 102 in the upper direction. As a result, the sandwiching member 54 on the upper side to which the pushed member 104 is fixed moves away (that is, in the upper direction in FIG. 9 or 10) from the sandwiching member 52 on the lower side. Also, when the sandwiching member 54 on the upper side moves away from the sandwiching member 52 on the lower side, the second rack 106 arranged in the sandwiching member 54 on the upper side also moves in the upper direction. As a result, the second pinion 107 rotates, and the detecting plate 108 rotates in a synchronized state with the second pinion 107. When the number of times of switching of the light interruptive state and the light transmissive state of the photointerrupter 110 reaches a predetermined number, driving of the first pinion 100 by the driving motor is stopped, whereby the movement of the sandwiching member 54 on the upper side is also stopped. In this case, regardless of the number of banknotes present between the sandwiching members 52 and 54, the amount of rotation of the second pinion 107 will always be a certain amount since the amount of rotation of the detecting plate 108 will always be a certain amount. Therefore, an amount of movement of the sandwiching member 54 on the upper side will be a certain amount since an amount of movement of the second pinion 107 will be a certain amount. Accordingly, even if the banknotes in a comparatively large number are present between the sandwiching members 52 and 54 as shown in FIG. 11, or even if the banknotes in a comparatively small number are present between the sandwiching members 52 and 54 as shown in FIG. 12, the distance between the sandwiching member 54 on the upper side and the stacked banknotes will be the same (that is, a distance represented by a reference letter "a" in FIG. 11 or 12).

In the conventional banknote handling apparatus, when releasing the stacked banknotes from the sandwiching members from their sandwiched state between the sandwiching members, the position of at least one of the sandwiching members is directly detected by a photointerrupter. Therefore, depending on the number of banknotes present between the sandwiching members, the distance between the sandwiching member on the upper side and the stacked banknotes when the stacked banknotes are released will change. Therefore, when a relatively small number of the banknotes are present between the sandwiching members, the distance between the sandwiching member on the upper side and the stacked banknotes when the stacked banknotes are released will be longer than desired. As a result, the banknotes may get folded or the state of the banknotes may change easily in this gap, leading to various problems (jamming). In contrast, in the present embodiment, in the second transporting unit 50, when releasing the stacked banknotes from the sandwiching members 52 and 54 from the state thereof sandwiched between the sandwiching members 52 and 54, the operation of moving the sandwiching member 54 on the upper side away from the sandwiching member 52 on the lower side is stopped when the distance between the sandwiching member 54 on the upper side and the stacked banknotes is equal to the predetermined distance. Therefore, regardless of the number of banknotes present between the sandwiching members 52 and 54, the distance between the sandwiching member 54 on the upper side and the stacked banknotes will always be the same distance. Accordingly, the occurrence of problems such as jamming of the banknotes because the banknotes get folded or the state in which the banknotes can easily change in the gap between the sandwiching member 54 on the upper side and the stacked banknotes, can be prevented.

On a depth side of the banknote ejecting/inserting mechanism 20 in the depth direction of the housing 12 (that is, the right side of the second transporting unit 50 in FIG. 2 and the like), is provided the dispensing temporary escrow unit 70 in which are accumulated the banknotes that should be dispensed and received from the transporting unit 80. The dispensing temporary escrow unit 70 is provided with a shutter 72 that is movable in the up-down direction in FIG. 2 and the like. While the banknotes are being sent from the transporting unit 80 to the dispensing temporary escrow unit 70 and the banknotes are accumulated in the dispensing temporary escrow unit 70, an opening on a left hand side of the dispensing temporary escrow unit 70 (that is, the opening on the second transporting unit 50 side) is closed by the shutter 72. On the other hand, when all the banknotes to be dispensed have been accumulated in the dispensing temporary escrow unit 70, the opening on the left hand side of the dispensing temporary escrow unit 70 is opened by moving the shutter 72 downward as shown in FIG. 7. As a result, the stacked banknotes accumulated in the dispensing temporary escrow unit 70 are sent to the second transporting unit 50 and the banknotes are sandwiched between the sandwiching members 52 and 54 of the second transporting unit 50.

An operation of inserting the banknotes from the outside of the housing 12 to the inside thereof and an operation of ejecting the banknotes from the inside of the housing 12 to the outside thereof performed by the banknote ejecting/inserting mechanism 20 having the above-explained configuration are explained below by using FIGS. 2 to 7.

When performing a money deposition process of the banknote in the banknote handling apparatus 10, an operator inserts the stacked banknotes into the banknote ejecting/inserting inlet 31 of the banknote ejecting/inserting mechanism 20 as shown in FIG. 2. The fact that the stacked banknotes have been inserted into the banknote ejecting/inserting inlet 31 is detected by the banknote detecting sensor not shown in FIG. 2 included in the banknote ejecting/inserting inlet 31. The detection of the banknote by the banknote detecting sensor triggers the driving of the endless belts 32 and 34 in the first transporting unit 30. Specifically, the endless belt 32 on the upper side rotates in a counterclockwise direction in FIG. 2, whereas the endless belt 34 on the lower side rotates in a clockwise direction in FIG. 2 at the same speed as the endless belt 32 on the upper side. When the endless belts 32 and 34 are driven, the stacked banknotes inserted into the banknote ejecting/inserting inlet 31 while being sandwiched between the endless belts 32 and 34 are transported in the horizontal state in the right direction in FIG. 2. When the stacked banknotes transported by the endless belts 32 and 34 abut with the receiving plate 38, the stacked banknotes are no longer transported in the right direction in FIG. 2, and the banknotes are suitably delivered to the second transporting unit 50 (see FIG. 3).

When the stacked banknotes are delivered from the first transporting unit 30 to the second transporting unit 50, the sandwiching member 52 on the lower side moves in the lower direction and the sandwiching member 54 on the upper side also moves in the lower direction. At this time, the stacked banknotes are not in the state of being sandwiched between the sandwiching members 52 and 54. When it is detected by the banknote detecting sensor 36 that the stacked banknotes delivered from the first transporting unit 30 to the second transporting unit 50 have protruded to the banknote ejecting/inserting inlet 31 side, the driving of the endless belts 32 and 34 of the first transporting unit 30 is continued without stopping. Accordingly, the banknotes that have protruded toward the banknote ejecting/inserting inlet 31 side are gathered on the sandwiching members 52 and 54 side (that is, the right side in FIG. 2) by the endless belt 34 on the lower side when the sandwiching member 52 on the lower side moves from the position shown in FIG. 3 in the lower direction. As a result, a non-aligned state of the stacked banknotes is fixed. In the conventional banknote handling apparatus, when delivering the stacked banknotes that are being transported while being sandwiched between a pair of endless belts to a subsequent transporting member, such as a stage, the stacked banknotes delivered from the endless belts to the subsequent transporting member are pushed away from the endless belts by a mechanism, such as a pushing lever, to fix a non-aligned state of the stacked banknotes. In this case, however, because it is necessary to provide the mechanism, such as a pushing lever, in the conventional banknote handling apparatus, the production cost increases and also the internal structure becomes complicated. In contrast, in the present embodiment, to fix the non-aligned state of the stacked banknotes when delivering the banknotes from the first transporting unit 30 to the second transporting unit 50, the endless belt 34 on the lower side in the first transporting unit 30 is used. Accordingly, the occurrence of jamming and the like in the second transporting unit 50 and the like can be prevented by fixing the non-aligned state of the stacked banknotes. Moreover, because it is not necessary to provide the mechanism, such as the pushing lever, as in the conventional banknote handling apparatus, the production cost can be suppressed. Note that, in the above explanation, when it is detected by the banknote detecting sensor 36 that the stacked banknotes delivered from the first transporting unit 30 to the second transporting unit 50 have protruded to the banknote ejecting/inserting inlet 31 side, the driving of the endless belts 32 and 34 of the first transporting unit 30 is continued without stopping. As another example, it is allowable to not provide the banknote detecting sensor 36, and, when the sandwiching member 52 on the lower side moves from the position shown in FIG. 3 in the lower direction, the driving of the endless belts 32 and 34 of the first transporting unit 30 can be always continued.

Figure 4:
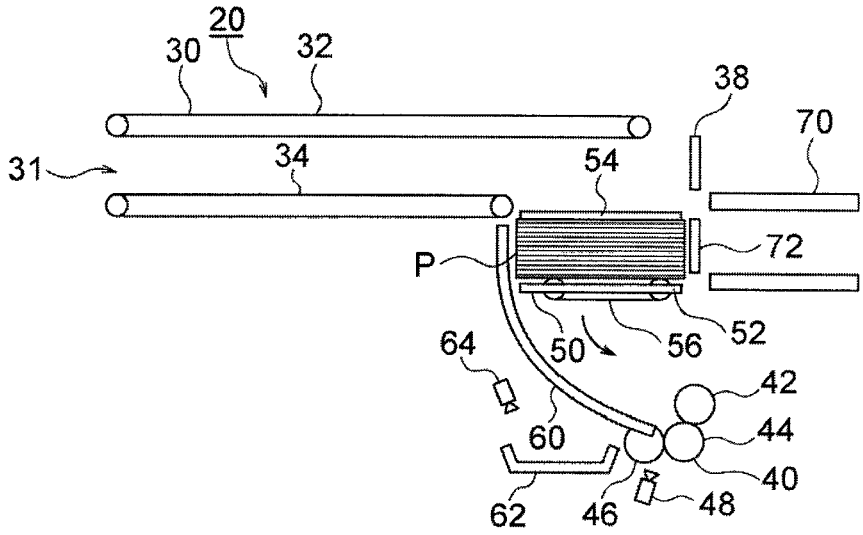
FIG. 4 is a side view of a state in which, in the banknote ejecting/inserting mechanism shown in FIG. 2 and the like, the stacked banknotes are being transported by the second transporting unit.

When the sandwiching members 52 and 54 reach a position shown in FIG. 4, the stacked banknotes will be sandwiched between the sandwiching members 52 and 54 by the movement of the sandwiching member 54 on the upper side toward the sandwiching member 52 on the lower side. Thereafter, while the stacked banknotes have been sandwiched between the sandwiching members 52 and 54, the sandwiching members 52 and 54 rotationally move around a predetermined axis along the holding member 60, and reach a position at which the sandwiching members 52 and 54 are inclined as shown in FIG. 5. While doing so, the stacked banknotes sandwiched between the sandwiching members 52 and 54 are also inclined from the horizontal state thereof so as to make an angle with respect to the horizontal plane. Then, the stacked banknotes are released from the sandwiching members 52 and 54 by the movement of the sandwiching member 54 on the upper side away from the sandwiching member 52 on the lower side. If foreign matter, such as a coin or a clip, is sandwiched between the stacked banknotes that have been caused to be inclined from the horizontal state thereof so as to make an angle with respect to the horizontal plane, the foreign matter falls out of the stacked banknotes, and further falls down from this holding member 60 after passing through the space between the rod-like members 60*a* of the holding member 60, and is finally received in the foreign matter receiving member 62. Also, by capturing an image of the foreign matter received in the foreign matter receiving member 62 by the image capturing unit 64, it is detected that the foreign matter has been received in the foreign matter receiving member 62.

When the sandwiching members 52 and 54 reach a position at which they are inclined as shown in FIG. 5, after the stacked banknotes are released from the sandwiching members 52 and 54, the sandwiching members 52 and 54 are caused to perform a back and forth movement. Specifically, the sandwiching members 52 and 54 rotate, along the holding member 60, around the predetermined axis in the direction shown with an arrow shown in FIG. 5. Accordingly, if foreign matter, such as a coin or a clip, is sandwiched between the stacked banknotes present between the sandwiching members 52 and 54, the foreign matter surely falls out from the swinging banknotes in the stacked state and the foreign matter is caught in the foreign matter receiving member 62. Therefore, the foreign matter can be surely removed from the stacked banknotes.

The back and forth movement of the sandwiching members 52 and 54 after the stacked banknotes are released from the sandwiching members 52 and 54 is not limited to the one explained above. As another example, when the sandwiching members 52 and 54 reach the position at which they are inclined as shown in FIG. 5, after the stacked banknotes are released from the sandwiching members 52 and 54, it is allowable to cause the sandwiching members 52 and 54 to perform a back and forth movement along a straight line that is orthogonal to a direction of inclination of the banknotes. As still another example, when the sandwiching members 52 and 54 reach the position shown at which they are inclined as shown in FIG. 5, after the stacked banknotes are released from the sandwiching members 52 and 54, it is allowable to cause the sandwiching members 52 and 54 to perform a back and forth movement along a straight line that is parallel to the direction of inclination of the banknotes.

As yet another example, when the sandwiching members 52 and 54 reach the position at which they are inclined as shown in FIG. 5, after the stacked banknotes sandwiched between the sandwiching members 52 and 54 are caused to be inclined at an angle to the horizontal plane, it is allowable to cause the sandwiching members 52 and 54 to move upward in a direction that is parallel to the direction of inclination of the banknotes (that is, a right up direction in FIG. 5). After the sandwiching members 52 and 54 have moved to an up position, the stacked banknotes sandwiched between the sandwiching members 52 and 54 are released from the sandwiching members 52 and 54. In this case, when returning the banknotes in the stacked state, which were released from the sandwiching members 52 and 54 after the sandwiching members 52 and 54 have moved to the up position, to their original position, the stacked banknotes collide with the rod-like members 60*a* of the holding member 60, and because of this mechanical shock, the foreign matter stuck between the stacked banknotes easily falls down. Therefore, the foreign matter can be surely removed.

It is possible that a pair of not-shown left and right endless belts is provided in the sandwiching member 54 on the upper side and having the same configuration as the left and right endless belts 56 of the sandwiching member 52 on the lower side. In this case, as yet another example, when the sandwiching members 52 and 54 reach the position at which they are inclined as shown in FIG. 5, after the stacked banknotes sandwiched between the sandwiching members 52 and 54 are caused to be inclined at an angle to the horizontal plane, it is allowable to cause, by using the endless belts 56 provided in the sandwiching member 52 on the lower side and the not-shown endless belts provided in the sandwiching member 54 on the upper side, the stacked banknotes to slide upward along the direction of inclination of the banknotes (that is, the right up direction in FIG. 5). The stacked banknotes are released from the sandwiching members 52 and 54 after sliding the stacked banknotes. In this case, when the stacked banknotes that have slid upward along the direction of inclination of the banknotes are released from the sandwiching members 52 and 54 and return to the original position thereof, the stacked banknotes collide with the rod-like members 60*a* of the holding member 60, and because of this mechanical shock, the foreign matter stuck between the stacked banknotes easily falls down. Therefore, the foreign matter can be surely removed.

As yet another example, after the stacked banknotes having been caused to be inclined at an angle to the horizontal plane are released from the sandwiching members 52 and 54, it is allowable for the holding member 60 to change a holding state of the stacked banknotes. Specifically, after the stacked banknotes are released from the sandwiching members 52 and 54, it is allowable that the holding member 60 causes the stacked banknotes to perform a back and forth movement along a direction that is parallel to the holding member 60. Even in this case, by changing the holding state of the stacked banknotes with the holding member 60, the foreign matter stuck between the stacked banknotes can be caused to fall down easily.

As yet another example, the second transporting unit 50 can include a not-shown hammering member that hammers the banknotes to change the holding state of the banknotes in the holding member 60 after the stacked banknotes having been caused to be inclined at an angle to the horizontal plane are released from the sandwiching members 52 and 54. When the hammering member is provided, by changing the holding state of the stacked banknotes held by the holding member 60, the foreign matter stuck between the stacked banknotes can be caused to fall down easily.

After the stacked banknotes having been caused to be inclined at an angle to the horizontal plane are released from the sandwiching members 52 and 54 as shown in FIG. 5, when the foreign matter is removed from the stacked banknotes because of the back and forth movement and the like of the sandwiching members 52 and 54, the stacked banknotes are sandwiched again by the sandwiching members 52 and 54, and the sandwiching members 52 and 54 rotationally move around the predetermined axis from their position shown in FIG. 5 to their position shown in FIG. 6 while sandwiching the stacked banknotes. When the sandwiching members 52 and 54 reach their position shown in FIG. 6, the sandwiching member 54 on the upper side moves away from the sandwiching member 52 on the lower side. Accordingly, the stacked banknotes are released from the sandwiching members 52 and 54, and the stacked banknotes are delivered from the second transporting unit 50 to the feeding unit 40. Subsequently, the banknotes are kicked downward one by one by the kicker rollers 42 in the feeding unit 40. The banknotes that have been kicked downward by the kicker rollers 42 pass through the gap between the feeding rollers 44 and the gate rollers 46, and the banknotes are separated one by one. The banknotes that have passed through the gap between the feeding rollers 44 and the gate rollers 46 are sent to the transporting unit 80, and the banknotes are transported by the transporting unit 80 inside the housing 12. In the present embodiment, after the stacked banknotes are delivered from the second transporting unit 50 to the feeding unit 40, when the banknotes are kicked downward one by one by the kicker rollers 42 in the feeding unit 40, the stacked banknotes are pushed toward the kicker rollers 42 by the sandwiching member 54 on the upper side in the second transporting unit 50. Accordingly, the operation of kicking the banknotes by the kicker rollers 42 can be performed surely.

The operation of ejecting the banknotes from the inside of the housing 12 to the outside thereof performed by the banknote ejecting/inserting mechanism 20 is explained below by referring to FIG. 7.

When performing the money dispensing process of the banknote in the banknote handling apparatus 10, the banknotes fed from the banknote cabinets 92 to the transporting unit 80 are accumulated in the dispensing temporary escrow unit 70 in a stacked state after being recognized by the recognition unit 82. While the banknotes are sent from the transporting unit 80 to the dispensing temporary escrow unit 70 and they are accumulated in the dispensing temporary escrow unit 70, the opening on the left hand side of the dispensing temporary escrow unit 70 (that is, the opening on the second transporting unit 50 side) in FIG. 2 and the like is closed by the shutter 72. When all the banknotes to be dispensed are accumulated in the dispensing temporary escrow unit 70, the opening on the left hand side of the dispensing temporary escrow unit 70 is opened by moving the shutter 72 downward as shown in FIG. 7. As a result, the stacked banknotes accumulated in the dispensing temporary escrow unit 70 are sent to the second transporting unit 50 and the banknotes are sandwiched between the sandwiching members 52 and 54 of the second transporting unit 50. When the stacked banknotes delivered from the dispensing temporary escrow unit 70 to the second transporting unit 50 are sandwiched between the sandwiching members 52 and 54, the sandwiching members 52 and 54 rotationally move around the predetermined axis along the holding member 60 and reach the position at which they are inclined as shown in FIG. 5. In doing so, the stacked banknotes sandwiched between the sandwiching members 52 and 54 are also inclined from the horizontal state thereof so as to make an angle with respect to the horizontal plane. Then, the stacked banknotes are released from the sandwiching members 52 and 54 by the movement of the sandwiching member 54 on the upper side away from the sandwiching member 52 on the lower side. Accordingly, the stacked banknotes are held by the holding member 60 in a state in which the banknotes are inclined at an angle to the horizontal plane, and the positions of edges of the stacked banknotes (that is, the edge on the bottom left side in FIG. 5) are aligned by the holding member 60.

Figure 3:
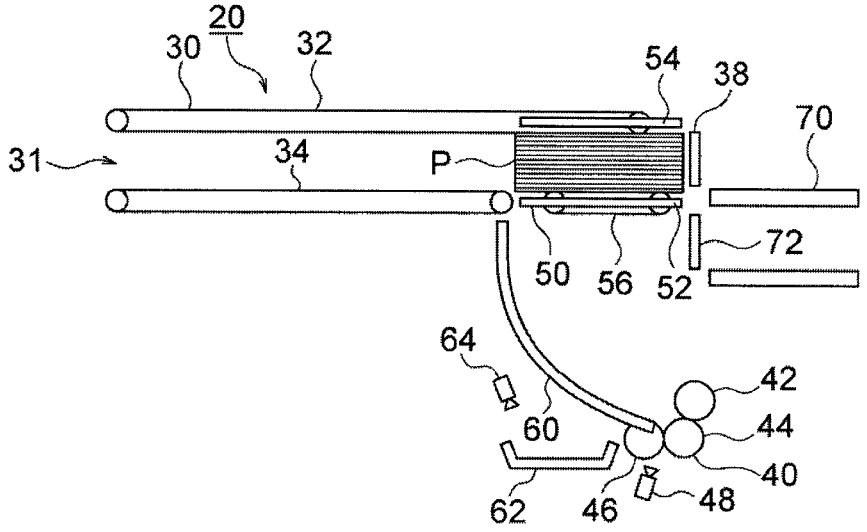
FIG. 3 is a side view of a state in which, in the banknote ejecting/inserting mechanism shown in FIG. 2, a plurality of the banknotes in a stacked state, or the stacked banknotes inserted in the banknote ejecting/inserting inlet have been delivered from a first transporting unit to a second transporting unit.

When the sandwiching members 52 and 54 reach the position at which they are inclined as shown in FIG. 5, after the stacked banknotes are released from the sandwiching members 52 and 54, the sandwiching members 52 and 54 perform a back and forth movement. Specifically, the sandwiching members 52 and 54 rotate, along the holding member 60, around the predetermined axis in the direction shown with the arrow in FIG. 5. Accordingly, because the stacked banknotes present between the sandwiching members 52 and 54 perform the back and forth movement along the holding member 60, the positions of the edges of the stacked banknotes are surely aligned by the holding member 60. Subsequently, the stacked banknotes are sandwiched between the sandwiching members 52 and 54, and with the stacked banknotes sandwiched, the sandwiching members 52 and 54 move to the position shown in FIG. 4. Then, the sandwiching members 52 and 54 move in the upper direction from the position shown in FIG. 4 and are positioned on the right side of the first transporting unit 30 as shown in FIG. 3. Subsequently, the endless belts 56 arranged on the sandwiching member 52 on the lower side and the endless belt 34 on the lower side of the first transporting unit 30 rotate in the counterclockwise direction in FIG. 3, and the endless belt 32 on the upper side of the first transporting unit 30 rotates in the clockwise direction in FIG. 3. Thereafter, the stacked banknotes are delivered from the second transporting unit 50 to the first transporting unit 30, and the stacked banknotes are transported by the first transporting unit 30 to the left direction in FIG. 3 and sent to the banknote ejecting/inserting inlet 31. When the stacked banknotes are sent to the banknote ejecting/inserting inlet 31 as shown in FIG. 2, the operator can remove the stacked banknotes from this banknote ejecting/inserting inlet 31 to the outside of the housing 12. Because the positions of the edges of the stacked banknotes (that is, the left edges of the banknotes in FIG. 2) are aligned by the holding member 60, when the operator removes the stacked banknotes from the banknote ejecting/inserting inlet 31, the positions of the edges of the stacked banknotes on the operator side will be in an aligned state, whereby it will be easy for the operator to grasp the stacked banknotes.

According to the banknote handling apparatus 10 and the banknote handling method implemented by the banknote handling apparatus 10 having such a configuration according to the present embodiment, the second transporting unit 50 that transports the stacked banknotes being transported by the first transporting unit 30 to the feeding unit 40 causes the stacked banknotes to be inclined from the horizontal state thereof so as to make an angle with respect to the horizontal plane. Accordingly, if a foreign matter, such as a coin or a clip, is sandwiched between the stacked banknotes, the foreign matter falls out of the stacked banknotes, which have been caused to be inclined from the horizontal state thereof so as to make an angle with respect to the horizontal plane, and the foreign matter can be removed before the stacked banknotes are sent to the feeding unit 40, whereby problems such as jamming can be prevented from occurring in the feeding unit 40 and the like. In the present embodiment, when the stacked banknotes are caused to be inclined from the horizontal state thereof so as to make an angle with respect to the horizontal plane, it is allowable that the stacked banknotes are moved by the second transporting unit 50 so that the angle of the banknotes with respect to the horizontal plane will be approximately 90 degrees, that is, the banknotes extend in the direction that is almost orthogonal to the horizontal plane.

As mentioned above, in the banknote handling apparatus 10 according to the present embodiment, the second transporting unit 50 includes the sandwiching members 52 and 54 that sandwich the stacked banknotes transported by the first transporting unit 30. In the second transporting unit 50, the stacked banknotes sandwiched between the sandwiching members 52 and 54 are caused to be inclined from the horizontal state thereof so as to make an angle with respect to the horizontal plane. In this case, when causing the stacked banknotes to be inclined from the horizontal state thereof so as to make an angle with respect to the horizontal plane, it can be prevented that the edges of the stacked banknotes are not aligned because of shifting of certain banknote or banknotes with respect to other banknotes.

As mentioned above, in the banknote handling apparatus 10 according to the present embodiment, the second transporting unit 50 is configured such that, after the stacked banknotes sandwiched between the sandwiching members 52 and 54 are caused to be inclined at an angle to the horizontal plane, the banknotes are released from the sandwiching members 52 and 54. Moreover, the second transporting unit 50 is configured such that, after the stacked banknotes sandwiched between the sandwiching members 52 and 54 are caused to be inclined at an angle to the horizontal plane and the banknotes are released from the sandwiching members 52 and 54, the sandwiching members 52 and 54 perform the back and forth movement. In this case, because the stacked banknotes are shaken by the sandwiching members 52 and 54 and the foreign matter stuck between the stacked banknotes easily falls down, the foreign matter can be surely removed from the stacked banknotes. Moreover, the second transporting unit 50 is configured such that, after the stacked banknotes sandwiched between the sandwiching members 52 and 54 are caused to be inclined at an angle to the horizontal plane and the banknotes are released from the sandwiching members 52 and 54, the sandwiching members 52 and 54 rotate around the predetermined axis. Alternatively, the second transporting unit 50 is configured such that, after the stacked banknotes sandwiched between the sandwiching members 52 and 54 are caused to be inclined at an angle to the horizontal plane and the banknotes are released from the sandwiching members 52 and 54, it is allowable to cause the sandwiching members 52 and 54 to perform a back and forth movement along a straight line that is orthogonal to the direction of inclination of the banknotes or parallel to the direction of inclination of the banknotes.

Alternatively, the second transporting unit 50 is configured such that, after the stacked banknotes being sandwiched between the sandwiching members 52 and 54 are caused to be inclined at an angle to the horizontal plane, it is allowable to cause the sandwiching members 52 and 54 to move upward in the direction that is parallel to the direction of inclination of the banknotes, and after the sandwiching members 52 and 54 have moved to the up position, release the stacked banknotes sandwiched between the sandwiching members 52 and 54 from the sandwiching members 52 and 54. In this case, when the sandwiching members 52 and 54 have been moved to the up position and the stacked banknotes are released from the sandwiching members 52 and 54 and returned to the original position thereof, the stacked banknotes collide with the rod-like members 60*a* of the holding member 60, and because of this mechanical shock, the foreign matter stuck between the stacked banknotes easily falls down. Therefore, the foreign matter can be surely removed. Moreover, it is allowable that the second transporting unit 50 includes, as a sliding member that slides the stacked banknotes sandwiched between the sandwiching members 52 and 54, the endless belts 56 arranged on the sandwiching member 52 on the lower side and the not-shown endless belts arranged on the sandwiching member 54 on the upper side. And, after the stacked banknotes sandwiched between the sandwiching members 52 and 54 are caused to be inclined at an angle to the horizontal plane, it is allowable to release the stacked banknotes from the sandwiching members 52 and 54 after the stacked banknotes that have been slid upward along the direction of inclination of the banknotes by the sliding member. In this case, when the stacked banknotes are slid upward along the direction of inclination of the banknotes, and released from the sandwiching members 52 and 54 and returned to the original position thereof, the stacked banknotes collide with the rod-like members 60*a* of the holding member 60, and because of this mechanical shock, the foreign matter stuck between the stacked banknotes easily falls down. Therefore, the foreign matter can be surely removed. Alternatively, in the second transporting unit 50, after the stacked banknotes sandwiched between the sandwiching members 52 and 54 are caused to be inclined at an angle to the horizontal plane and the banknotes are released from the sandwiching members 52 and 54, it is allowable that the stacked banknotes are slid upward along the direction of inclination of the banknotes by the endless belts 56, and the banknotes are returned to their original position by the endless belts 56 thereafter. Even in this case, when the stacked banknotes are returned to their original position by the endless belts 56, the stacked banknotes collide with the rod-like members 60*a* of the holding member 60, and because of this mechanical shock, the foreign matter stuck between the stacked banknotes easily falls down. Therefore, the foreign matter can be surely removed.

As mentioned above, in the banknote handling apparatus 10 according to the present embodiment, the second transporting unit 50 further includes the holding member 60 that holds the edges on the lower side of the stacked banknotes that are inclined by the sandwiching members 52 and 54 at an angle to the horizontal plane and released from the sandwiching members 52 and 54. In this case, it is prevented that the stacked banknotes released from the sandwiching members 52 and 54 scatter whereby the edges of the stacked banknotes are not aligned. Moreover, the second transporting unit 50 is configured such that, after the stacked banknotes having been caused to be inclined at an angle to the horizontal plane are released from the sandwiching members 52 and 54, it is allowable that the holding member 60 changes the holding state of the stacked banknotes. Specifically, after the stacked banknotes are released from the sandwiching members 52 and 54, it is allowable that the holding member 60 causes the stacked banknotes to perform the back and forth movement. Even in this case, by changing the holding state of the stacked banknotes with the holding member 60, the foreign matter sandwiched between the stacked banknotes is caused to fall down easily. Moreover, the second transporting unit 50 further includes the hammering member that hammers the banknotes to change the holding state of the banknotes in the holding member 60 after the stacked banknotes having been caused to be inclined at an angle to the horizontal plane are released from the sandwiching members 52 and 54. When the hammering member is provided, by changing the holding state of the stacked banknotes held by the holding member 60, the foreign matter sandwiched between the stacked banknotes is caused to fall down easily.

As mentioned above, in the banknote handling apparatus 10 according to the present embodiment, the sandwiching members 52 and 54 are arranged at a downstream end of the first transporting unit 30, and the stacked banknotes transported by the first transporting unit 30, when moved by the sandwiching members 52 and 54, are pushed toward the sandwiching members 52 and 54 (that is, the right side in FIG. 2 and the like) by the first transporting unit 30 (specifically, the endless belt 34 on the lower side). Accordingly, even if the stacked banknotes that are delivered from the first transporting unit 30 to the second transporting unit 50 have protruded toward the banknote ejecting/inserting inlet 31 side, the banknotes that have protruded toward the banknote ejecting/inserting inlet 31 side are gathered on the sandwiching members 52 and 54 side (that is, the right side in FIG. 2 and the like) by the endless belt 34 on the lower side when the sandwiching member 52 on the lower side moves from the position shown in FIG. 3 in the lower direction. As a result, a non-aligned state of the banknotes in the stacked banknotes can be fixed. In the present embodiment, because the endless belt 34 on the lower side in the first transporting unit 30 is used to fix the non-aligned state of the banknotes in the stacked banknotes when delivering the banknotes from the first transporting unit 30 to the second transporting unit 50, the occurrence of jamming or the other problems in the second transporting unit 50 and the like can be prevented by fixing the non-aligned state of the banknotes in the stacked banknotes, and because it is not necessary to provide the mechanism, such as the pushing lever, as in the conventional banknote handling apparatus, the production cost can be suppressed.

As mentioned above, in the banknote handling apparatus 10 according to the present embodiment, the second transporting unit 50 is configured such that, when releasing the stacked banknotes having been caused to be inclined at an angle to the horizontal plane from the sandwiching members 52 and 54, the operation to move the sandwiching members 52 and 54 away from each other is stopped when the distance between one of the sandwiching members among the sandwiching members 52 and 54 (specifically, the sandwiching member 54 on the upper side) and the banknotes is the predetermined distance. Therefore, regardless of the number of banknotes present between the sandwiching members 52 and 54, the distance between the sandwiching member 54 on the upper side and the stacked banknotes will always be the same distance. Accordingly, the occurrence of problems such as jamming of the banknotes because of folding of the banknotes or changing of the state of the banknotes in the gap between the sandwiching member 54 on the upper side and the stacked banknotes can be prevented.

As mentioned above, in the banknote handling apparatus 10 according to the present embodiment, the stacked banknotes to be ejected to the outside of the housing 12 are sent from the dispensing temporary escrow unit 70 to the second transporting unit 50, and the stacked banknotes to be ejected to the outside of the housing 12 which is sent to the second transporting unit 50 are caused to be inclined at an angle to the horizontal plane after being sandwiched between the sandwiching members 52 and 54. Moreover, after these banknotes are released from the sandwiching members 52 and 54, the edges of the banknotes are aligned by the edges on the lower side of the banknotes being held by the holding member 60. In this case, the stacked banknotes to be dispensed are sent to the banknote ejecting/inserting inlet 31, and when the operator removes the stacked banknotes from the banknote ejecting/inserting inlet 31, the positions of the edges of the stacked banknotes on the operator side will be in the aligned state, whereby it will be easy for the operator to grasp the stacked banknotes.

As mentioned above, in the banknote handling apparatus 10 according to the present embodiment, when feeding the banknotes with the feeding unit 40, one of the sandwiching members between the sandwiching members 52 and 54 (specifically, the sandwiching member 54 on the upper side) pushes the stacked banknotes toward the kicker roller 42 of the feeding unit 40. Accordingly, the operation of kicking the banknotes by the kicker roller 42 can be performed surely.

Note that, the banknote handling apparatus 10 and the banknote handling method implemented by the banknote handling apparatus 10 according to the present embodiment are not limited to the embodiments explained above, and various changes can be made thereto.

For example, it is allowable to provide in the first transporting unit 30 or the second transporting unit 50 foreign matter detecting unit that detects the foreign matter, such as a coin or a clip, sandwiched between the stacked banknotes. Such foreign matter detecting unit is, for example, a camera that captures an image from a side of the stacked banknotes transported between the endless belts 32 and 34 of the first transporting unit 30, a camera that captures an image from a side of the stacked banknotes that are delivered from the first transporting unit 30 to the second transporting unit 50 and present between the sandwiching members 52 and 54 of the second transporting unit 50. It is allowable that, only when the foreign matter is detected by the foreign matter detecting unit, the second transporting unit 50 is configured such that, the stacked banknotes sandwiched between the sandwiching members 52 and 54 are caused to be inclined at an angle to the horizontal plane, and after these banknotes are released from the sandwiching members 52 and 54, the sandwiching members 52 and 54 perform the back and forth movement. That is, it is allowable that, when no foreign matter is detected by the foreign matter detecting unit arranged in the first transporting unit 30 or the second transporting unit 50, after the stacked banknotes delivered from the first transporting unit 30 to the second transporting unit 50 are sandwiched between the sandwiching members 52 and 54, the banknotes are transported to the feeding unit 40 without being released from the sandwiching members 52 and 54 on the way, and the stacked banknotes are delivered from the second transporting unit 50 to the feeding unit 40.

When it is detected by the camera that captures an image from a side of the stacked banknotes transported between the endless belts 32 and 34 of the first transporting unit 30, or by the camera that captures an image from a side of the stacked banknotes that are delivered from the first transporting unit 30 to the second transporting unit 50 and present between the sandwiching members 52 and 54 of the second transporting unit 50 that the stacked banknotes have been bundled with a bundling member, such as a bundling paper-tape or a rubber band, these stacked banknotes are returned to the banknote ejecting/inserting inlet 31 by the first transporting unit 30 without being sent to the feeding unit 40 by the second transporting unit 50. Moreover, in this case, a warning message can be displayed on a not-shown displaying unit, which can be arranged on a front surface or a top surface of the housing 12 of the banknote handling apparatus 10, and/or a warning announcement can be made from a not-shown speaker.

The first transporting unit 30 is not limited to the one in which the stacked banknotes inserted in the banknote ejecting/inserting inlet 31 are transported between the endless belts 32 and 34. A first transporting unit according to a variation can have a configuration in which the stacked banknotes inserted in a banknote ejecting/inserting inlet are placed in a cart member, and the stacked banknotes are transported to the second transporting unit by the cart member.

In the embodiment of the banknote ejecting/inserting mechanism 20 shown in FIG. 2 and the like, the feeding unit 40 is arranged below the first transporting unit 30 and the second transporting unit 50; however, the present embodiment is not limited to this configuration. In a banknote ejecting/inserting mechanism according to another variation, the feeding unit can be arranged above the first transporting unit and/or the second transporting unit.

In the second transporting unit 50 of the banknote ejecting/inserting mechanism 20, when releasing the stacked banknotes having been caused to be inclined at an angle to the horizontal plane from the sandwiching members 52 and 54, the operation of stopping the movement of the sandwiching members 52 and 54 away from each other when the distance between one of the sandwiching members between the sandwiching members 52 and 54 (specifically, the sandwiching member 54 on the upper side) and the banknotes is the predetermined distance is not limited to the above explained method of using the second rack 106, the second pinion 107, the detecting plate 108, and the photointerrupter 110. As another alternative, a not-shown detecting member that detects a distance between the sandwiching members 52 and 54 can be arranged in the second transporting unit 50. If information about the number of the stacked banknotes being sandwiched between the sandwiching members 52 and 54 in the second transporting unit 50 is received by a not-shown controlling unit of the banknote handling apparatus 10, when the distance between the sandwiching members 52 and 54 detected by the detecting member is equal to a predetermined distance that is set based on the number of banknotes that can be present between the sandwiching members 52 and 54, the operation of moving the sandwiching members 52 and 54 away from each other can be stopped. Specifically, when the distance between the sandwiching members 52 and 54 detected by the detecting member is equal to a sum of a thickness of the stacked banknotes calculated based on the number of banknotes that can be present between the sandwiching members 52 and 54 and a desirable distance between the sandwiching member 54 on the upper side and the stacked banknotes (that is, a distance represented by the reference letter "a" in FIG. 11 or 12), the operation of moving the sandwiching members 52 and 54 away from each other can be stopped. In this configuration, even if the second rack 106, the second pinion 107, the detecting plate 108, the photointerrupter 110, and the like are not arranged in the second transporting unit 50, when releasing the stacked banknotes having been caused to be inclined at an angle to the horizontal plane from the sandwiching members 52 and 54, regardless of the number of banknotes present between the sandwiching members 52 and 54, the distance between the sandwiching member 54 on the upper side and the stacked banknotes will always be the same distance. Accordingly, the occurrence of problems such as jamming of the banknotes because of folding of the banknotes or the state of the banknotes can easily change in the gap between the sandwiching member 54 on the upper side and the stacked banknotes can be prevented.

Figure 14:
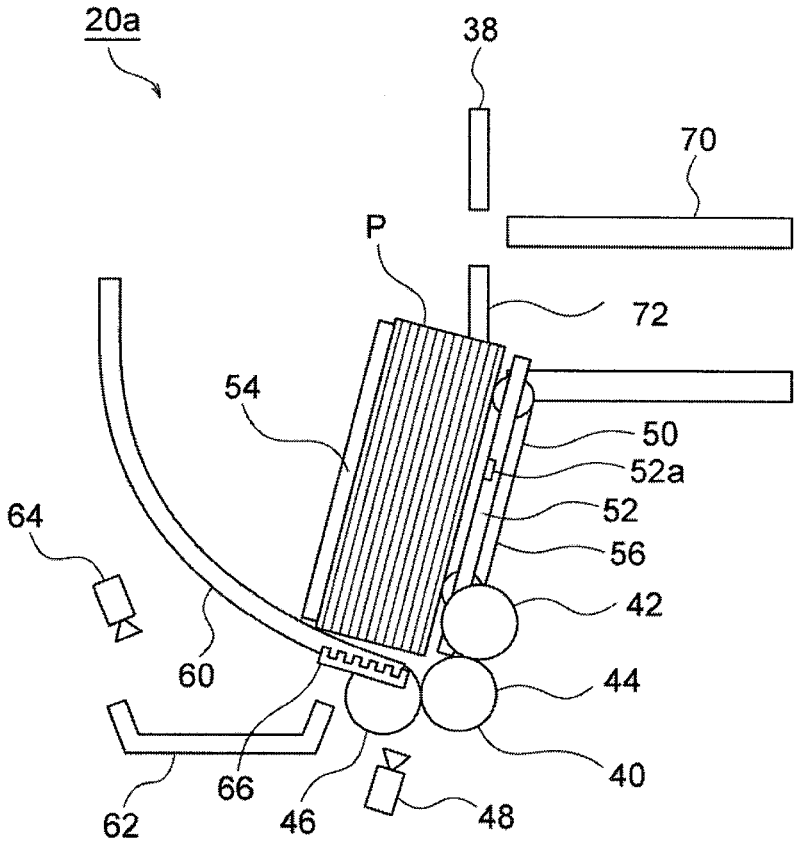
FIG. 14 is a side view of a configuration of a banknote ejecting/inserting mechanism according to a variation.
Figure 15:
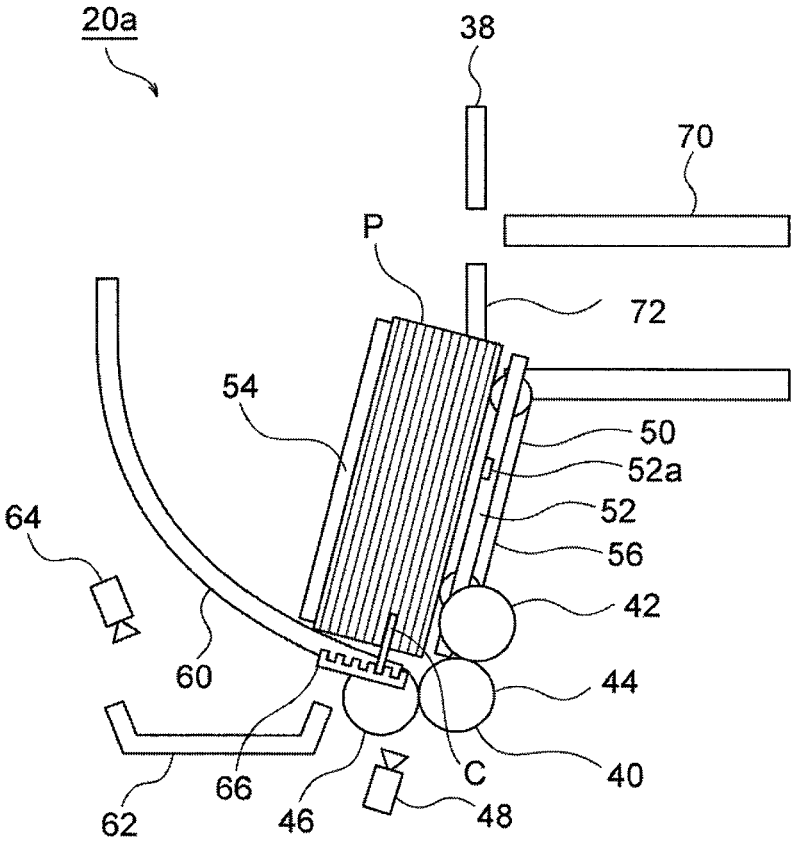
FIG. 15 is a side view of a state in which a coin is received in a coin receiving unit in the banknote ejecting/inserting mechanism shown in FIG. 14.

A banknote ejecting/inserting mechanism **20*a* having a configuration shown in FIGS. 14 and 15 can be used as the banknote ejecting/inserting mechanism for inserting the banknote from the outside of the housing 12 to the inside thereof and ejecting the banknote from the inside of the housing 12 to the outside thereof. The banknote ejecting/inserting mechanism 20*a* shown in FIGS. 14 and 15 is different from the banknote ejecting/inserting mechanism 20 shown in FIGS. 2 to 13 only in that it is additionally provided with a coin receiving unit 66 below the holding member 60 near the feeding unit 40, and additionally provided with a pressing force detecting sensor 52*a* on a surface of the sandwiching member 52 on the lower side that opposes the sandwiching member 54 on the upper side. The other structural components are substantially the same as the banknote ejecting/inserting mechanism 20 shown in FIGS. 2 to 13. In the explanation of the banknote ejecting/inserting mechanism 20*a* according to the variation shown in FIGS. 14 and 15, the same reference numbers will be assigned to the structural components that are the same as those in the banknote ejecting/inserting mechanism 20 shown in FIGS. 2 to 13, and the explanation thereof will be omitted. Note that, in FIGS. 14 and 15, the first transporting unit 30 of the banknote ejecting/inserting mechanism 20*a*** has been omitted.

In the banknote ejecting/inserting mechanism 20*a* according to the variation shown in FIGS. 14 and 15, after the sandwiching members 52 and 54 are moved to the second position and the stacked banknotes are delivered from the second transporting unit 50 to the feeding unit 40, when feeding the banknotes one by one by the feeding unit 40 to the inside of the housing 12, the stacked banknotes are pushed toward the kicker rollers 42 of the feeding unit 40 by the sandwiching member 54 on the upper side. A pressing force applied on the stacked banknotes by the sandwiching member 54 on the upper side is detected by the pressing force detecting sensor 52*a* arranged to the sandwiching member 54 on the lower side.

Meanwhile, if a coin is mixed with the stacked banknotes delivered from the second transporting unit 50 to the feeding unit 40, when this coin falls down from the stacked banknotes, the coin is received by the coin receiving unit 66 as shown in FIG. 15. A top surface of the coin receiving unit 66 has a comb-teeth structure, and a width of grooves of the comb-teeth structure is slightly larger than a thickness of the largest coin. When the coin received by the coin receiving unit 66 enters in a groove of the comb-teeth structure, this coin will be in a standing state extending upward from the coin receiving unit 66, whereby a portion of the coin remains between the stacked banknotes. Accordingly, even if the stacked banknotes delivered to the feeding unit 40 are pushed toward the kicker rollers 42 of the feeding unit 40 by the sandwiching member 54 on the upper side, the pressing force is disadvantageously blocked by the coin in the standing state received in the coin receiving unit 66 whereby the pressing force applied on the stacked banknotes by the sandwiching member 54 on the upper side is not detected by the pressing force detecting sensor 52*a*. In the variation shown in FIGS. 14 and 15, depending on whether the pressing force applied on the stacked banknotes by the sandwiching member 54 on the upper side of the stacked banknotes is detected by the pressing force detecting sensor 52*a*, it can be determined whether a coin has been received in the coin receiving unit 66.

If it is determined that the coin has been received by the coin receiving unit 66 based on a detection result obtained by the pressing force detecting sensor 52*a*, the operation of feeding the banknotes by the feeding unit 40 is stopped, and a warning message can be displayed on a not-shown displaying unit, which can be arranged on a front surface or a top surface of the housing 12 of the banknote handling apparatus 10, and/or a warning announcement can be made from a not-shown speaker. Moreover, when it is determined that the coin has been received in the coin receiving unit 66, it is allowable that the second transporting unit 50 moves from the second position to the first position while sandwiching the stacked banknotes by the sandwiching members 52 and 54, then, the stacked banknotes are delivered from the second transporting unit 50 to the first transporting unit 30, and the stacked banknotes are returned to the banknote ejecting/inserting inlet 31 by the endless belts 32 and 34 of the first transporting unit 30.

The paper sheet handled by the paper sheet handling apparatus and the paper sheet handling method according to the present invention is not limited to the banknote. The paper sheet handling apparatus and the paper sheet handling method according to the present invention can handle paper sheets other than the banknotes (specifically, checks, gift certificates, and the like) as the stacked paper sheets.

The invention claimed is:

1. A paper sheet handling apparatus comprising:

a first transporting unit configured to transport a plurality of paper sheets in a stacked state in a horizontal state;

a second transporting unit configured to receive and transport the stacked paper sheets transported by the first transporting unit, the second transporting unit including a sandwiching unit that has an upper sandwiching member and a lower sandwiching member and is configured to sandwich the stacked paper sheets received from the first transporting unit and release the stacked paper sheets, and a holding member configured to hold edges on a lower side of the stacked paper sheets released from the sandwiching unit; and a feeding unit configured to feed the stacked paper sheets transported by the second transporting unit one by one, wherein the sandwiching unit is configured to move so that the stacked paper sheets being sandwiched by the sandwiching unit are inclined from the horizontal state so as to make an angle to a horizontal plane while the edges on the lower side of the stacked paper sheets are held by the holding member.

2. The paper sheet handling apparatus as claimed in claim 1, wherein after the stacked paper sheets sandwiched by the sandwiching unit are inclined at an angle to the horizontal plane, the paper sheets are released from the sandwiching unit.

3. The paper sheet handling apparatus as claimed in claim 2, wherein after the stacked paper sheets sandwiched by the sandwiching unit are inclined at an angle to the horizontal plane and these paper sheets are released from the sandwiching unit, the sandwiching unit performs a back and forth movement.

4. The paper sheet handling apparatus as claimed in claim 3, wherein after the stacked paper sheets sandwiched by the sandwiching unit are inclined at an angle to the horizontal plane and the paper sheets are released from the sandwiching unit, the sandwiching unit rotates around a predetermined axis.

5. The paper sheet handling apparatus as claimed in claim 3, wherein after the stacked paper sheets sandwiched by the sandwiching unit are inclined at an angle to the horizontal plane and the stacked paper sheets are released from the sandwiching unit, the sandwiching unit performs a back and forth movement in a direction being orthogonal to a direction of inclination of the stacked paper sheets.

6. The paper sheet handling apparatus as claimed in claim 3, wherein after the stacked paper sheets sandwiched by the sandwiching unit are inclined at an angle to the horizontal plane and the stacked paper sheets are released from the sandwiching unit, the sandwiching unit performs a back and forth movement along a direction of inclination of the stacked paper sheets.

7. The paper sheet handling apparatus as claimed in claim 3, wherein the first transporting unit or the second transporting unit includes a foreign matter detecting unit configured to detect foreign matter other than the paper sheet, and the second transporting unit is configured such that, only when the foreign matter is detected by the foreign matter detecting unit, the stacked paper sheets sandwiched by the sandwiching unit are caused to be inclined at an angle to the horizontal plane, and after these paper sheets are released from the sandwiching unit, the sandwiching unit performs the back and forth movement.

8. The paper sheet handling apparatus as claimed in claim 2, wherein after the stacked paper sheets sandwiched by the sandwiching unit are caused to be inclined at an angle to the horizontal plane, the sandwiching unit moves to an upward position along a direction of inclination of the stacked paper sheets, and after the sandwiching unit has moved to the upward position, the stacked paper sheets sandwiched by the sandwiching unit are released from the sandwiching unit.

9. The paper sheet handling apparatus as claimed in claim 2, wherein the second transporting unit includes a sliding member that slides the stacked paper sheets sandwiched by the sandwiching unit, and after the stacked paper sheets sandwiched by the sandwiching unit are caused to be inclined at an angle to the horizontal plane, the stacked paper sheets are slid upward along the direction of inclination of the paper sheets by the sliding member, and then the stacked paper sheets are released from the sandwiching unit.

10. The paper sheet handling apparatus as claimed in claim 1, wherein after the stacked paper sheets having been caused to be inclined at an angle to the horizontal plane are released from the sandwiching unit, the holding member causes the stacked paper sheets to perform a back and forth movement.

11. The paper sheet handling apparatus as claimed in claim 1, wherein the stacked paper sheets having been caused to be inclined at an angle to the horizontal plane are released from the sandwiching unit, and an operation of moving the upper sandwiching member and the lower sandwiching member away from each other is stopped when a distance between the upper sandwiching member and the stacked paper sheets becomes a predetermined distance.

12. The paper sheet handling apparatus as claimed in claim 1, wherein the second transporting unit further includes a detecting unit configured to detect a distance between the upper sandwiching member and the lower sandwiching member, and when the distance detected by the detecting unit becomes a predetermined distance based on the number of paper sheets present between the upper sandwiching member and the lower sandwiching member, an operation of moving the upper sandwiching member and the lower sandwiching member away from each other is stopped.

13. The paper sheet handling apparatus as claimed in claim 1, further comprising a temporary escrow unit that temporarily escrows therein the stacked paper sheets to be ejected to the outside of a housing, wherein the stacked paper sheets to be ejected to the outside of the housing and sent from the temporary escrow unit to the second transporting unit are caused to be inclined at an angle to the horizontal plane after the stacked paper sheets are sandwiched by the sandwiching unit, and then the stacked paper sheets are released from the sandwiching unit, and the edges of the stacked paper sheets are aligned by the edges on the lower side of the stacked paper sheets being held by the holding member.

14. The paper sheet handling apparatus as claimed in claim 1, wherein a gap is formed between the upper sandwiching member and the stacked paper sheets placed on a lower holding member by moving an upper holding member in a direction away from the lower holding member.

15. The paper sheet handling apparatus as claimed in claim 1, wherein the feeding unit includes a kicker roller configured to kick downward the stacked paper sheets one by one, and the upper sandwiching member presses the stacked paper sheets toward the kicker roller when the stacked paper sheets are fed one by one by the feeding unit.

16. The paper sheet handling apparatus as claimed in claim 1, wherein the second transporting unit is arranged at one end of the first transporting unit, and the holding member is disposed so as to extend in a curbed shape from the one end of the first transporting unit toward the feeding unit.

17. The paper sheet handling apparatus as claimed in claim 1, wherein a receiving member configured to receive the stacked paper sheets is disposed at an end of the second transporting unit opposite to the first transporting unit.

18. The paper sheet handling apparatus as claimed in claim 1, further comprising a foreign matter receiving unit configured to receive a foreign matter dropped from the stacked paper sheets, wherein the foreign matter receiving unit is provided below the holding member.

19. The paper sheet handling apparatus as claimed in claim 18, wherein the holding member has an opening through which the foreign matter passes.

* * * * *